US007975513B2

(12) United States Patent
Lonati et al.

(10) Patent No.: US 7,975,513 B2
(45) Date of Patent: Jul. 12, 2011

(54) TURNING DEVICE FOR TUBULAR KNITTED ARTICLES, PARTICULARLY FOR SEWING OR LOOPING STATIONS FOR THE AUTOMATED CLOSING OF TUBULAR ARTICLES AT AN AXIAL END THEREOF

(75) Inventors: Ettore Lonati, Botticino (IT); Tiberio Lonati, Brescia (IT); Fausto Lonati, Brescia (IT)

(73) Assignee: Lonati S.p.A., Brescia (IT)

( * ) Notice: Subject to any disclaimer, the term of this patent is extended or adjusted under 35 U.S.C. 154(b) by 0 days.

(21) Appl. No.: 12/867,651

(22) PCT Filed: Feb. 20, 2009

(86) PCT No.: PCT/EP2009/052045

§ 371 (c)(1),
(2), (4) Date: Aug. 13, 2010

(87) PCT Pub. No.: WO2009/112348

PCT Pub. Date: Sep. 17, 2009

(65) Prior Publication Data

US 2010/0313608 A1 Dec. 16, 2010

(30) Foreign Application Priority Data

Mar. 10, 2008 (MT) ..... MI2008A0399

(51) Int. Cl.
*D04B 9/56* (2006.01)

(52) U.S. Cl. ..... 66/148

(58) Field of Classification Search ..... 66/148, 66/19, 31, 58, 48, 147, 47
See application file for complete search history.

(56) References Cited

U.S. PATENT DOCUMENTS

| | | | | |
|---|---|---|---|---|
| 6,164,091 | A * | 12/2000 | Frullini et al. | 66/148 |
| 6,389,849 | B1 * | 5/2002 | Conti | 66/148 |
| 6,698,250 | B2 * | 3/2004 | Lonati et al. | 66/149 S |
| 7,107,797 | B2 * | 9/2006 | Frullini et al. | 66/148 |
| 2004/0154341 | A1 * | 8/2004 | Conti | 66/149 S |
| 2006/0144095 | A1 * | 7/2006 | Frullini et al. | 66/8 |

* cited by examiner

FOREIGN PATENT DOCUMENTS

| | | | |
|---|---|---|---|
| EP | 1 118 700 | A1 | 7/2001 |
| WO | WO 02/070801 | A1 | 9/2002 |
| WO | WO 2004/035894 | A1 | 4/2004 |

OTHER PUBLICATIONS

International Search Report and Written Opinion regarding PCT/EP2009/052045.

*Primary Examiner* — Danny Worrell
(74) *Attorney, Agent, or Firm* — Husch Blackwell LLP

(57) ABSTRACT

A turning device for tubular knitted articles, particularly for sewing or looping stations for the automated closing of tubular articles at an axial end thereof comprising a lower portion and an upper portion, which are arranged respectively below and above an intermediate region at which elements are or can be positioned for supporting the tubular article to be turned, which hangs at one of its axial ends and is arranged substantially vertically, a tubular body, which can be inserted from the bottom upwardly, with its upper axial end, through the axial end of the article that hangs from the supporting elements, so as to evert the article onto the outer lateral surface of the tubular body, extracting it progressively from the upper axial end of the tubular body. Auxiliary sliding elements are provided, which can move on command with respect to the tubular body, parallel to the axis of the tubular body, and can engage and disengage cyclically the article everted onto the outer lateral surface of the tubular body in order to produce its sliding toward the lower axial end of the tubular body.

13 Claims, 21 Drawing Sheets

TURNING DEVICE FOR TUBULAR KNITTED ARTICLES, PARTICULARLY FOR SEWING OR LOOPING STATIONS FOR THE AUTOMATED CLOSING OF TUBULAR ARTICLES AT AN AXIAL END THEREOF

TECHNICAL FIELD

The present invention relates to a turning device or turner for tubular knitted articles, particularly for sewing or looping stations for the automated closing of tubular articles at an axial end thereof.

BACKGROUND ART

Techniques for performing the automated closing of tubular knitted articles, particularly hosiery items, at an axial end thereof, at the end of their production cycle on circular hosiery knitting machines, are known.

Some of these techniques are based on picking up the article, at the end of its production cycle, from the circular hosiery knitting machine and on transferring it to a sewing or looping station, which is generally arranged laterally with respect to the machine used to produce the article.

In the sewing or looping station a sewing or looping head is provided, by means of which the axial end of the article, usually constituted by the axial end at which the production of the article has ended, is closed.

Some techniques are based on the use of a single device both to pick up the article from the machine that produced it and to support the article during the sewing or looping operation to close its axial end. In other techniques, a device for picking up the article and transferring it to the sewing or looping station and a handling device which is arranged in the sewing station and is used to prepare the article for the subsequent sewing or looping operation and optionally to move the article during sewing or looping with respect to the sewing or looping head, are provided.

Usually, the article is picked up from the machine that produced it and optionally transferred to the handling device by engaging individually the loops of knitting of the last formed row of knitting of the article, and the loops of knitting of a half-row of said last row of knitting are made to face individually the loops of knitting of the other half-row before proceeding with sewing or looping, so that the axial end of the article is closed by joining in each instance two mutually facing loops of the two half-rows that compose the last formed row of knitting. Thanks to this fact, an excellent result is achieved in terms of precision and aesthetics in the automated closing of axial ends of tubular knitted articles, particularly hosiery.

In both of these techniques, quite often the sewing or looping operation is performed on the article turned inside out, so that the sewing or looping chain stitch is scarcely visible on the right side of the article, i.e., on the side that normally is visible when the item is being worn.

For this reason, in sewing or looping stations designed to perform these techniques for closing an axial end of tubular knitted articles generally there is a turner, which is designed to turn inside out the article, which is picked up in the right-side-out configuration from the machine that produced it, before subjecting it to the sewing or looping operation and optionally to turn it again in order to bring it to the right-side-out configuration after the sewing or looping operation.

One of the most widespread types of turners for this type of use is based on the use of a tubular body that is made to face in a downward region the article that is supported by means of a pick-up device or by means of a handling device at its axial end to be closed and is arranged substantially vertically with said axial end directed upwardly. The tubular body also is arranged so that its axis is vertical, so that its upper axial end faces the hanging article. The interior of the tubular body is then connected to suction means so as to aspirate, through its upper axial end, the article, which remains in any case retained, at its axial end to be closed, by the pick-up device or by the handling device. The tubular body is then raised so as to pass, with its upper axial end, through the axial end of the article that is engaged with the pick-up device or with the handling device. As a consequence of this passage, the article is everted on the outer lateral surface of the tubular body and is extracted progressively from the upper axial end of the tubular body, turning it inside out.

In the case of significantly long tubular articles, such as for example in the case of pantyhoses, difficulties can be encountered in obtaining, with turners of this kind, the complete eversion of the article onto the outer lateral surface of the tubular body. Similar problems are encountered when the article must be returned to the right-side-out configuration, by means of a new turning, after performing sewing or looping. This new turning is in fact performed by sucking the article into the tubular body through the lower axial end of the tubular body. In this case also, a considerable length of the article can in fact hinder its complete suction through the lower axial end of the tubular body of the turner.

In order to solve this problem, turners have been devised which have very long tubular bodies and therefore have substantial vertical space occupations, which make locating and installing these turners difficult. As an alternative, turners have been devised which are provided with rollers that have horizontal axes and face the outer lateral surface of the tubular body. These rollers can be actuated on command with a rotary motion about the respective axes and can move toward the outer lateral surface of the tubular body, so as to engage the portion of the article that is already everted onto the outer lateral surface of the tubular body, so as to complete its eversion, or away from the outer lateral surface of the tubular body so as to not interfere with it in other operating conditions.

The use of rollers to assist and complete the eversion of the article on the outer lateral surface of the tubular body, while allowing to reduce the vertical space occupation of turners, is not devoid of drawbacks.

The action of the rollers can in fact be scarcely tolerated by particularly delicate articles, which may break due to the friction produced by the rollers.

Moreover, the rotary action of the rollers on the article can be scarcely productive in terms of the entrainment of the article on the outer lateral surface of the tubular body in the case of very glossy articles.

DISCLOSURE OF THE INVENTION

The aim of the present invention is to solve the problems described above by providing a turning device for tubular knitted articles, particularly for sewing or looping stations for the automated closing of tubular articles at an axial end thereof, which ensures correct turning even of significantly long articles and can to have a reduced vertical space occupation.

Within this aim, an object of the invention is to provide a turner that ensures correct turning even of particularly glossy or delicate articles, avoiding the danger of damage or breakage thereof.

Another object of the invention is to provide a turner that is highly reliable and precise in operation.

Still another object of the invention is to provide a turner that is structurally simple and can be manufactured at competitive costs.

This aim and these and other objects that will become better apparent hereinafter are achieved by a turning device for tubular knitted articles, particularly for sewing or looping stations for the automated closing of tubular articles at an axial end thereof, comprising a lower portion and an upper portion, which are arranged respectively below and above an intermediate region at which means are or can be positioned for supporting the tubular article to be turned, which hangs at one of its axial ends and is arranged substantially vertically, and a tubular body, which can be inserted from the bottom upwardly, with its upper axial end, through said axial end of the article that hangs from said supporting means after aspirating the article through said upper axial end of the tubular body, for the eversion of the article, retained by said supporting means, onto the outer lateral surface of said tubular body with progressive extraction of the article from said upper axial end of the tubular body, characterized in that it comprises auxiliary sliding means, which can move on command with respect to said tubular body, parallel to the axis of said tubular body, and can engage and disengage cyclically the article everted onto the outer lateral surface of said tubular body in order to produce the sliding of the article toward the lower axial end of said tubular body.

BRIEF DESCRIPTION OF THE DRAWINGS

Further characteristics and advantages of the invention will become better apparent from the description of a preferred but not exclusive embodiment of the turner according to the invention, illustrated by way of non-limiting example in the accompanying drawings, wherein:

FIG. 8 is a schematic view of the step for positioning an article at a sewing or looping station in which the turner according to the invention is arranged, said turner being shown in an axial sectional view taken along a vertical plane that is perpendicular to the sectional plane of FIG. 6;

FIGS. 9 and 10 are schematic enlarged-scale views of a detail of the elements shown in FIG. 8, illustrating the step of individual passage of the loops of knitting of an article from the pick-up members of a pick-up device to the supporting means, with the turner shown in axial cross-section;

FIGS. 11 to 13 are schematic sectional views, similar to FIG. 8, of the step for turning the article that hangs from the supporting means;

FIG. 14 is a schematic sectional view, similar to FIG. 8, of the step for superimposing each of the loops of knitting of a half-row of knitting on a corresponding loop of knitting of the other half-row of the row of knitting of the article that hangs from the supporting means by turning, through an arc of substantially 180°, one half-row of knitting with respect to the other half-row, and of the step for sewing or looping the mutually superimposed pairs of loops of knitting;

FIG. 15 is a schematic sectional view of FIG. 14*a*, taken along a plane passing through line XV-XV, with some elements omitted for the sake of simplicity and for greater clarity;

FIG. 16 is a sectional view, similar to FIG. 14*a*, of the step for disengaging the article from the supporting means;

FIG. 17 is a schematic sectional view of FIG. 16, taken along a plane passing through line XVII-XVII, with some elements omitted for the sake of simplicity and for greater clarity;

FIG. 18 is a schematic sectional view, similar to FIG. 8, of the step for spacing the article from the turner;

FIG. 19 is a schematic sectional view, similar to FIG. 8, of the return of the turner to the condition shown in FIG. 8.

Figure 1:
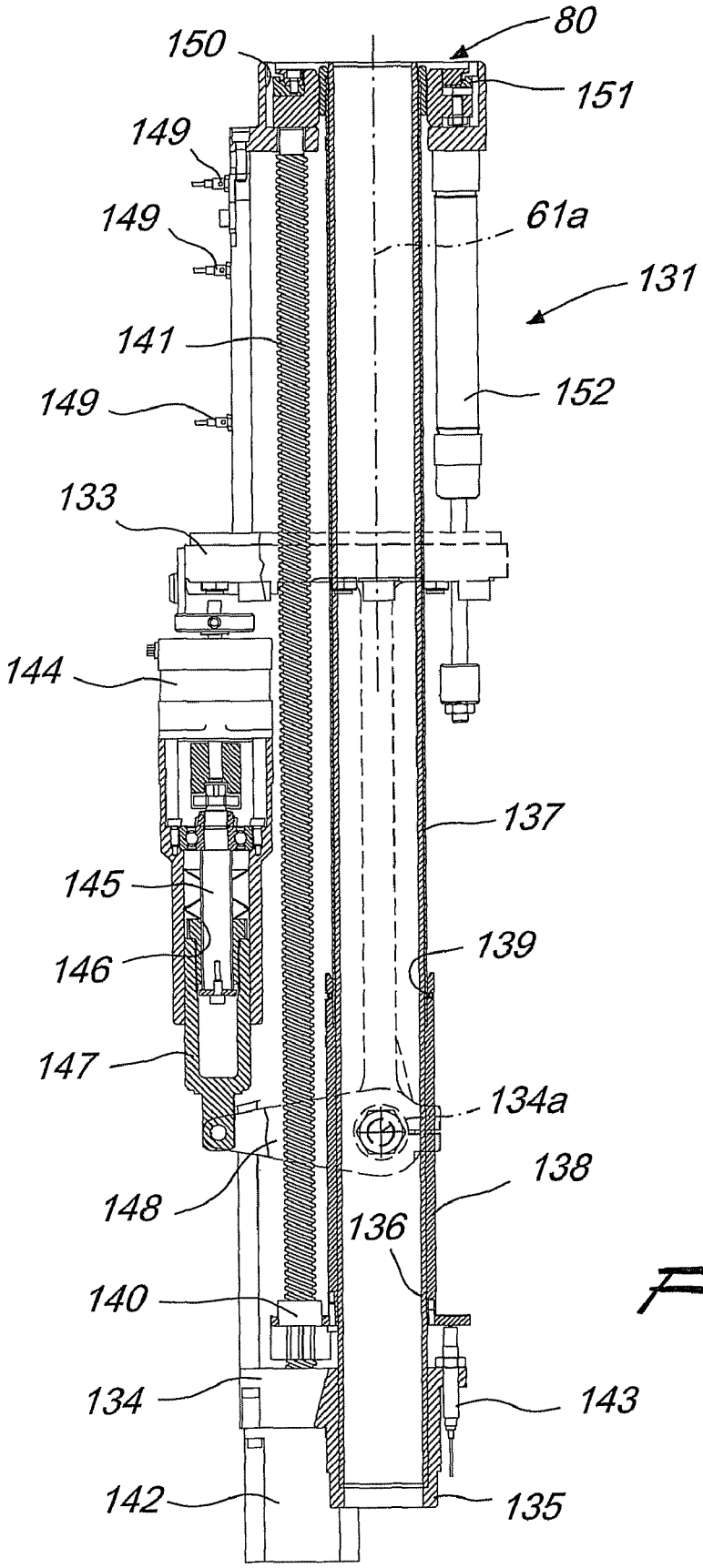
FIG. 1 is a schematic axial sectional view of the lower portion of the turner and of the tubular body, arranged so that their axis is vertical.

The turning device or turner according to the invention is described with reference to its preferred use in a sewing or looping station 102 to close an axial end of a knitted tubular article 101, such as for example a hosiery item, which is produced on a circular hosiery knitting machine, without altering the fact that the turner according to the invention can be used more generally simply to turn a tubular article, regardless of whether one proceeds or not with closure by sewing or looping an axial end thereof.

Ways of Carrying Out the Invention

With reference to the figures, the turning device or turner according to the invention, generally designated by the reference numeral 130, substantially comprises a lower portion 131 and an upper portion 132, which are arranged respectively below and above an intermediate portion at which means are or can be positioned for supporting the tubular article 101 to be turned, which hangs at one of its axial ends and is arranged substantially vertically.

The turner 130 comprises a tubular body 137, which can be inserted upwardly from below with its upper axial end through the axial end of the article 101 that hangs from the supporting means after aspirating the article 101 through the upper axial end of the tubular body 137 so as to cause the eversion of the article 101, retained by the supporting means, onto the outer lateral surface of the tubular body 137, with progressive extraction of the article 101 from the upper axial end of the tubular body 137, as will become better apparent hereinafter.

According to the invention, the turner 130 comprises auxiliary sliding means 159, which can move on command with respect to the tubular body 137 parallel to the axis of the tubular body 137 and can cyclically engage and disengage the article 101 everted onto the outer lateral surface of the tubular body 137 in order to produce the sliding of the article 101 toward the lower axial end of the tubular body 137.

More particularly, the means for supporting the article 101, arranged at the intermediate region between the lower portion 131 and the upper portion 132 of the turner 130, comprise a handling device 60, which is provided with an annular body 61 that is arranged so that its axis or main axis 61*a* is vertical.

The body 61 has, on its lower face, a plurality of spikes 62, which are arranged along an to imaginary cylindrical surface whose axis coincides with the axis 61*a* and lie parallel to the axis 61*a*. The spikes 62 are adapted to support the article 101 to be turned so that it hangs from the spikes 62 with its upper axial end, and the tubular body 137 can be positioned so that its axis lies at the vertical main axis 61*a* and can move on command along the axis 61*a*.

If the turner, as in the illustrated embodiment, is designed to be positioned in a sewing or looping station to close an axial end of the article 101, the body 61 of the handling device 60 is composed of two half-rings 63*a*, 63*b*, which are pivoted to each other about a diametrical axis 64. One of the two half-rings, constituted by the half-ring 63*b*, can be overturned on command with respect to the other half-ring 63*a* about the diametrical axis 64, so as to make each spike 62 of the half-ring 63*b* face and align with a corresponding spike 62 of the half-ring 63*a*. Preferably, when the two half-rings 63*a*, 63*b* are in a coplanar position, the spikes 62 are directed with their tip downwardly and the half-ring 63*b* can be turned over about the diametrical axis 64 so as to face the half-ring 63*a* in a downward region.

The handling device 60 can move from the sewing or looping station 102 to the machine used to produce the article 101 to be turned and vice versa, in order to directly pick up the article 101 from the machine and carry it to the sewing or looping station 102.

As an alternative, as in the illustrated embodiment, the handling device 60 is arranged permanently in the sewing or looping station 102 and the article 101 to be turned is picked from the machine that produced it and is transferred to the handling device 60 by means of a pick-up device, also provided at the looping station and generally designated by the reference numeral 10 and shown in FIGS. 8 to 13.

The pick-up device 10 comprises an annular pick-up body 11, with an axis 11*a*, which supports a plurality of pick-up members 29. Each pick-up member 29 has a laminar body, which is arranged on a radial plane with respect to the axis 11*a* and can move on command toward or away from the axis 11*a*.

The pick-up body 11 is arranged so that its axis 11*a* is vertical. The pick-up members 29 are uniformly angularly spaced around the axis 11*a* in a manner that corresponds to the angular spacing between the needles of the circular hosiery knitting machine used to produce the article 101, so that by positioning the pick-up body 11 coaxially around the needle cylinder of the machine and moving it appropriately along its own axis 11*a*, each pick-up member faces radially a needle of the machine. The pick-up members 29, in the illustrated example, have their end directed toward the axis 11*a* that is shaped like a hook that is open upwardly. Such end can engage the corresponding needle of the machine, which each pick-up member 29 is made to face so as to pick up the loop of knitting from such needle, removing the article 101 from the machine that produced it. The same end of each pick-up member 29 can be coupled to a spike 62, so as to transfer the article 101 from the pick-up device 10 to the handling device 60. The spikes 62 are in fact angularly spaced one another around the axis 61*a* uniformly according to an angular spacing that corresponds to the spacing between the pick-up members 29 of the pick-up device 10. In practice, each pick-up member 29 is matched by a spike 62 of the handling device 60, and when the pick-up device 10 is arranged in the sewing or looping station 102 the pick-up body 11 is in a position that lies coaxially to the body 61 of the handling device 60, with the pick-up members 29 arranged around the ring of spikes 62 and with each pick-up member 29 radially aligned with a spike 62.

The transfer of the loops of knitting of the article 101 from the pick-up members 29 to the spikes 62 of the handling device 60 is performed by arranging the pick-up body 11 coaxially below the body 61 and by engaging the end of each pick-up member 29 with one of the spikes 62, while the half-ring 63*b* is in a coplanar position with respect to the half-ring 63*a*, i.e., before turning over below to the half-ring 63*a*, as will become better apparent hereinafter.

In the illustrated embodiment, the body 61 is connected coaxially around a hollow cylinder 65, which has a vertical axis and is supported, so that it can rotate about its own axis, which coincides with the axis 61*a*, by a supporting structure 66. The half-ring 63*a* is fixed to the outer lateral surface of the hollow cylinder 65, while the half-ring 63*b* is pivoted to the hollow cylinder 65 about the diametrical axis 64, as shown in particular in FIG. 6.

The hollow cylinder 65 is fixed coaxially to a gear 67, which meshes with another gear 68 that is fixed to the shaft of an electric motor 69 that is supported by the supporting structure 66. The actuation of the electric motor 69 causes the rotation of the hollow cylinder 65 about its own axis and therefore the rotation of the body 61 about the axis 61*a* with respect to the supporting structure 66.

Figure 6:
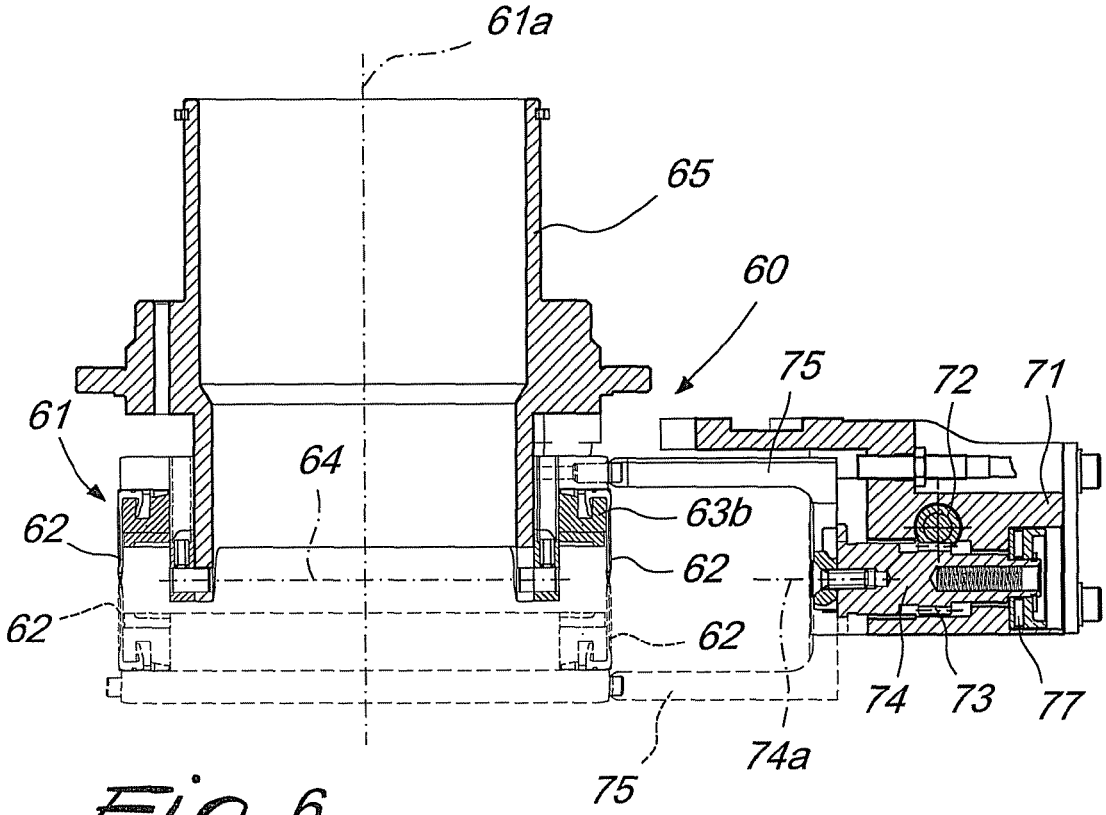
FIG. 6 is an axial sectional view, taken along a vertical plane, of the means for supporting the article.
Figure 7:
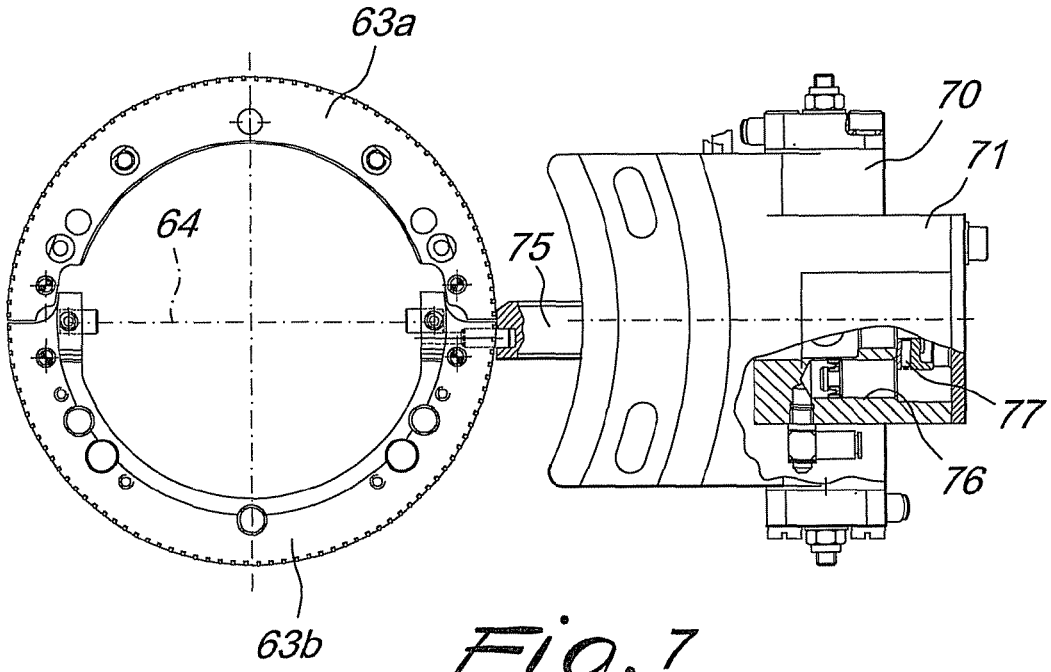
FIG. 7 is a top plan view of the means for supporting the article, with some elements omitted for the sake of simplicity and for greater clarity.

The overturning of the half-ring 63*b* about the diametrical axis 64, as shown in FIGS. 6 and 7, is actuated by means of a double-acting fluid-actuated cylinder 70, which is mounted on a block 71, which in turn is supported by a portion of the supporting structure 66. The fluid-actuated cylinder 70 is connected, by means of the stem of its piston, to a rack 72, which meshes with a toothed portion 73 that is jointly connected to a shaft 74 that can rotate with respect to the block 71 about its own axis 74*a*, which is oriented at right angles to the axis 61*a* of the body 61 and of the hollow cylinder 65. The shaft 74 is fixed to an arm 75, which has a portion that is parallel and spaced from the axis 74*a* and can engage a portion of the half-ring 63*b*. The actuation of the fluid-actuated cylinder 70 in one direction or in the other, by means of the rack 72 and the toothed portion 73, causes the rotation, in one direction or the other, of the shaft 74 and therefore the passage of the half-ring 63*b* from the position that is coplanar to the half-ring 63*a* to the position in which it is overturned below it or vice versa.

Conveniently, the shaft 74 can move on command along its own axis 74*a* with respect to the block 71 by way of the action of a fluid-actuated cylinder 76, which is mounted on the block 71 and acts with its piston on the shaft 74 with the interposition of a bearing 77, so as to engage or disengage the arm 75 with the half-ring 63*b*.

It should be noted that means are provided for locking the half-ring 63*b* in a position in which it is coplanar with respect to the half-ring 63*a*. As shown, such means can be constituted by a pin 90, which is supported by the supporting structure 66 and can move, by way of the action of a fluid-actuated cylinder 91 that is connected by means of its body to the supporting structure 66, away from the axis 61*a*, in contrast with a return spring 92, to disengage from a seat 93 that is defined in the half-ring 63*b*. In practice, the action of the return spring 92 ensures the engagement of the pin 90 with the seat 93 and therefore the support of the half-ring 63*b* in a position that is coplanar with respect to the half-ring 63*a*. When the half-ring 63*b* is to be overturned, the pin 90 is disengaged beforehand from the seat 93 by way of the actuation of the fluid-actuated cylinder 91.

Conveniently, first axial pusher means 80 are provided, which interact with the pick-up members 29 of the pick-up device 10, when they are coupled to the spikes 62, and with the spikes 62 of the handling device 60, so as to actuate the individual passage of the loops of knitting from the pick-up members 29 to the spikes 62, of course if the pick-up device 10 is provided.

Moreover, second axial pusher means 81 are provided, which interact with the spikes 62 of the handling device 60 in order to produce the passage of the loops of knitting from the spikes 62 of the half-ring 63*a* to the spikes 62 of the half-ring 63*b* when the latter is overturned below the half-ring 63*a*, or to disengage the article 101 from the spikes 62 of the half-ring 63*b* after the sewing or looping operation, as will become better apparent hereinafter.

The lower portion 131 and the upper portion 132 of the turner 130 can be positioned coaxially to each other, along the main vertical axis 61*a*, and the to tubular body 137 can be supported by means of the lower portion 131 or by means of the upper portion 132.

The lower portion 131 of the turner 130 comprises lower means for supporting the tubular body 137 and lower means for actuating the tubular body 137 along the axis 61*a*, in order to make the tubular body 137 pass through the body 61 of the handling device 60, starting from a lowered position, in which the tubular body 137 protrudes, with its upper axial end, below the body 61 of the handling device 60, to a raised position, in which it is arranged with its upper axial end above the body 61 of the handling device 60 and with its lower axial end proximate to the body 61 of the handling device 60.

Figure 2:
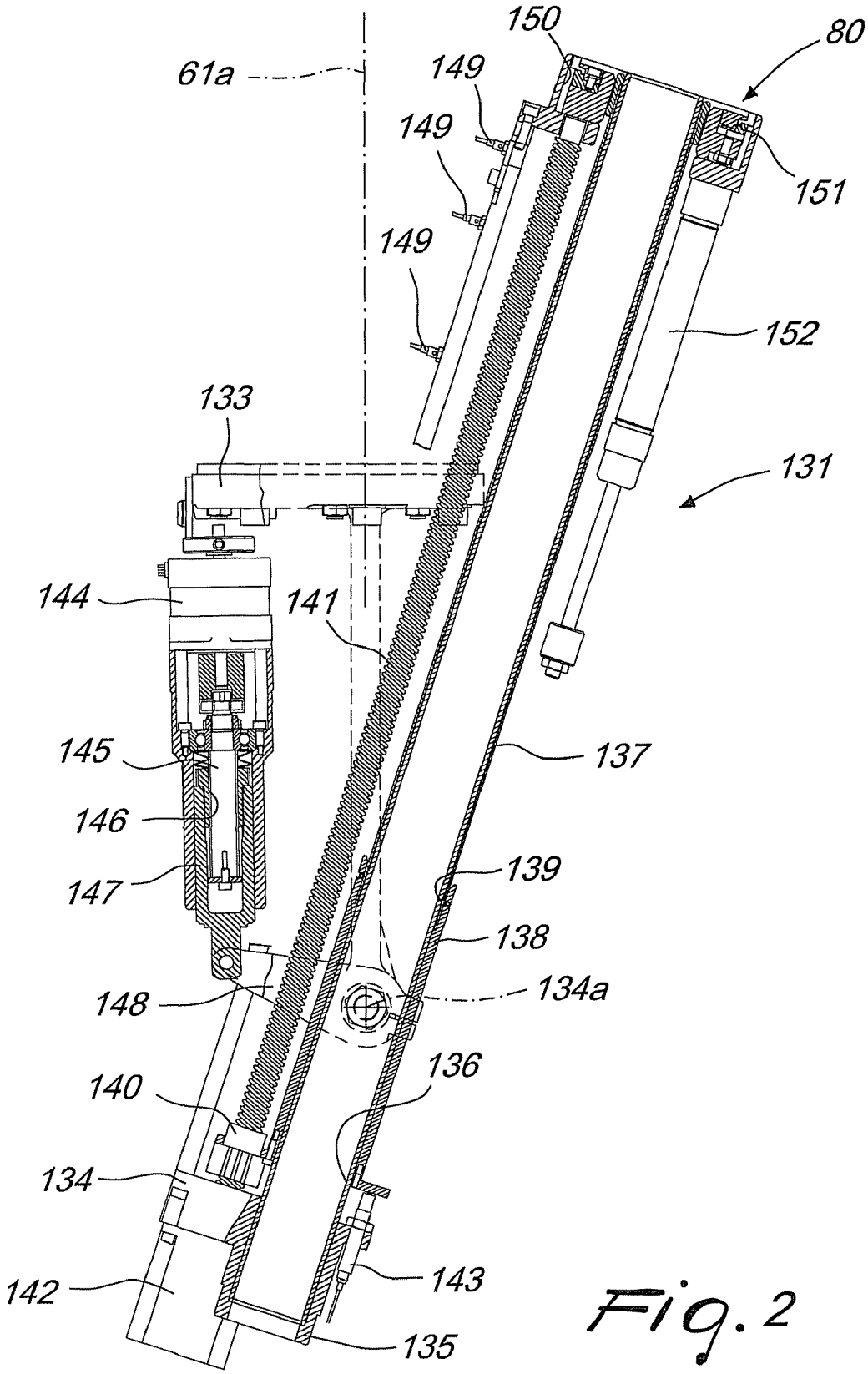
FIG. 2 is a schematic axial sectional view of the lower portion of the turner and of the tubular body, arranged so that their axis is inclined with respect to the vertical.

In greater detail, the lower supporting means of the tubular body 137, as shown in particular in FIGS. 1 and 2, comprise a lower supporting structure 133, which can be part of the supporting structure 66 or can be an autonomous supporting structure. The lower supporting structure 133 supports, so that it can rotate about a horizontal axis 134*a*, a frame 134. A footing 135 is fixed to the frame 134 and a hollow lower guiding cylinder 136 is jointly connected to such footing. The lower guiding cylinder 136 is fixed to the footing 135 with its lower end and the horizontal axis 134*a* is arranged in an intermediate region of the axial extension of the lower guiding cylinder 136.

The frame 134 can rotate on command in order to pass from an inclined position, shown in FIG. 2, in which the axis of the lower guiding cylinder 136 is inclined with respect to the vertical so as to move, with its upper end, closer to the machine used to produce the article 101, to a vertical position, shown for example in FIG. 1, in which its axis coincides with the axis 61*a*.

The lower guiding cylinder 136 is adapted to support, so as to allow axial sliding, the tubular body 137, which is open at its axial ends, and can be fitted coaxially around the lower guiding cylinder 136.

The lower actuation means, in order to produce the passage of the tubular body 137 from the lowered position to the raised position cited above, comprise a lower sleeve 138, which is fitted coaxially, and so that it can slide axially, around the lower guiding cylinder 136. A seat 139 is defined in the upper end of the lower sleeve 138 and the lower axial end of the tubular body 137 can engage therein by resting contact.

The lower sleeve 138 is connected to a block 140, in which there is a lead screw that mates with a threaded shaft 141 which is supported, so that it can rotate about its own axis, by the frame 134 and is oriented so that its axis lies parallel to the axis of the lower guiding cylinder 136. The threaded shaft 141 is fixed to the output shaft of an electric motor 142, which is mounted on the frame 134 and can be actuated to cause the rotation of the threaded shaft 141 and therefore the sliding of the lower sleeve 138 along the lower guiding cylinder 136.

The position of the lower sleeve 138 along the lower guiding cylinder 136 can be controlled by means of appropriately provided sensors 143, 149, which are arranged on the frame 134.

The rotation of the frame 134 about the horizontal axis 134*a*, with respect to the lower supporting structure 133, is obtained by means of a linear actuator, constituted by an electric motor 144 which is mounted on the lower supporting structure 133 and is connected by means of its output shaft to a threaded shaft 145 which mates with a lead screw 146 defined in a hollow shaft 147. The hollow shaft 147 is pivoted to a lever 148 that is jointly connected to the frame 134 and is pivoted to the lower supporting structure 133 about the horizontal axis 134*a*.

An annular seat 150 is defined in the frame 134, around the upper end of the lower guiding cylinder 136, and is coaxial to the lower guiding cylinder 136. The first axial pusher means 80 comprise an annular body 151, which can be accommodated coaxially in the annular seat 150. The annular body 151 is connected to the stem of the piston of a fluid-operated cylinder 152, which is connected by means of its body to the frame 134 and is oriented so that its axis lies parallel to the axis of the lower guiding cylinder 136. The fluid-actuated cylinder 152 can be actuated in order to produce the movement in one direction or in the opposite direction of the annular body 151 along the axis of the lower guiding cylinder 136.

The peripheral profile of the face of the annular body 151 that is directed upwardly is preferably comb-shaped, with teeth that can be inserted between the pick-up members 29 of the pick-up device 10 when the pick-up body 11 is moved into the sewing or looping station 102, or is coupled by means of its pick-up members 29 with the spikes 62 of the handling device 60.

Figure 3:
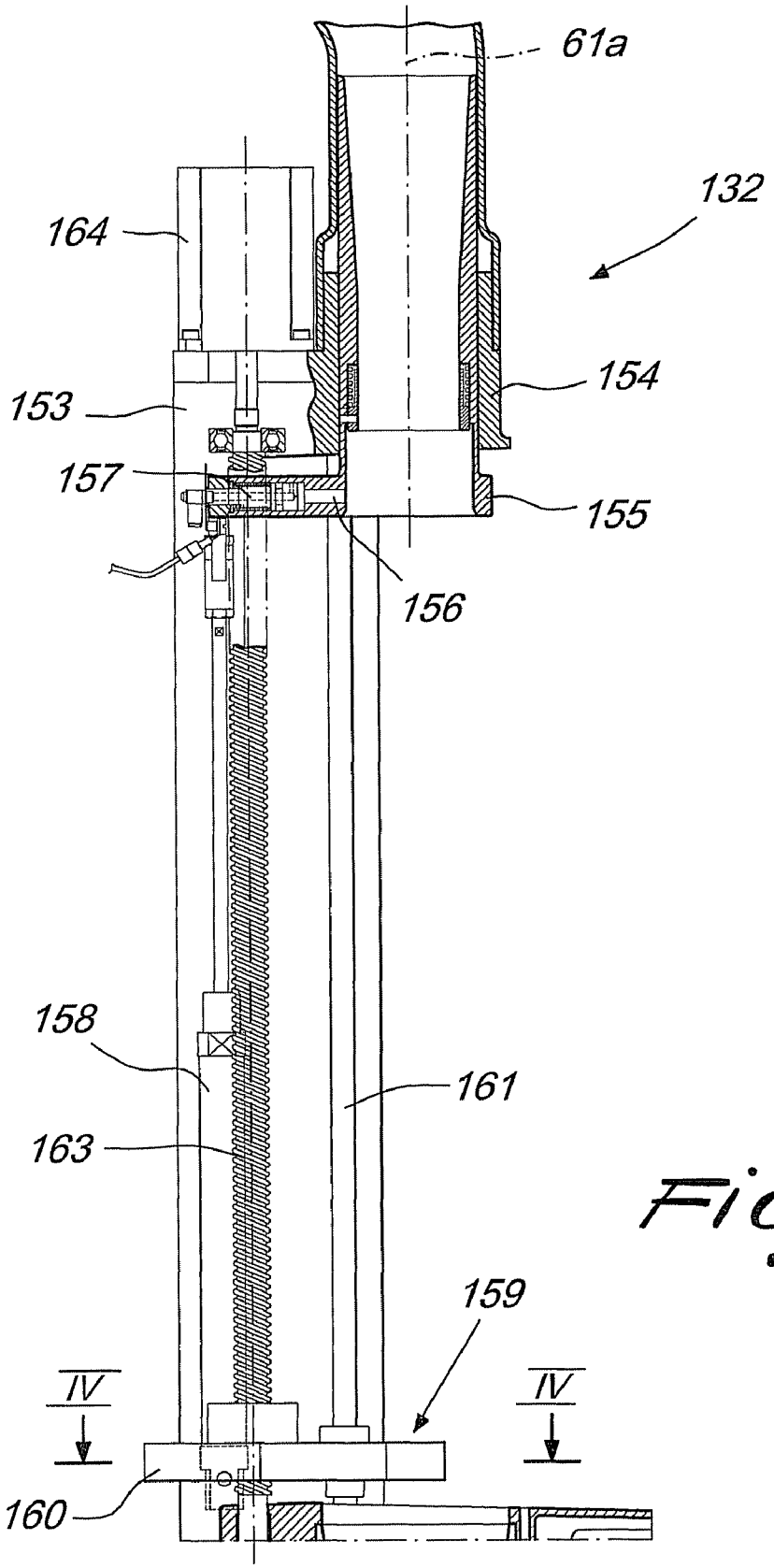
FIG. 3 is a schematic axial sectional view of the upper portion of the turner.

The upper portion 132, as shown in particular in FIG. 3, comprises upper supporting means, which can engage the upper axial end of the tubular body 137 and upper actuation means to actuate the lifting of the tubular body 137 from said raised position, which can be obtained by way of the activation of the electric motor 142, to a further raised position, in which its lower axial end is spaced upwardly with respect to the body 61 of the handling device 60.

In greater detail, the upper portion 132 comprises an upper supporting structure 153, which can be an integral part of the lower supporting structure 133 or can be an autonomous supporting structure. The upper supporting structure 153 supports a fixed upper sleeve 154, which is arranged upwardly and coaxially with respect to the hollow cylinder 65.

The upper supporting means and the upper actuation means comprise a movable upper sleeve 155, which mates internally and coaxially with the fixed upper sleeve 154 and can move axially with respect to it.

The lower end of the movable upper sleeve 155 can be coupled to the upper axial end of the tubular body 137 and is provided with locking means to engage the upper axial end of the tubular body 137.

More particularly, the upper axial end of the tubular body 137 has a protruding edge, which can be inserted in the lower end of the movable upper sleeve 155. The movable upper sleeve 155 has, proximate to its lower end, a movable pin 156, which is oriented radially with respect to the axis of the movable upper sleeve 155 and is connected to the piston of a fluid-operated cylinder 157, which is connected by means of its body to the movable upper sleeve 155 and can be actuated to move the movable pin 156. The movable pin 156, as a consequence of the actuation of the fluid-actuated cylinder 157, can protrude radially from the internal surface of the movable upper sleeve 155, defining a lower stop shoulder for the protruding edge of the upper axial end of the tubular body 137, which is inserted in the movable upper sleeve 155, contrasting its extraction from the movable upper sleeve 155 and thus supporting the tubular body 137.

The movable upper sleeve 155 is connected to the stem of the piston of a fluid-actuated cylinder 158, which is connected by means of its body to the upper supporting structure 153 and is oriented so that its axis is parallel to the axis of the movable upper sleeve 155. The fluid-actuated cylinder 158 can be actuated to actuate the movement of the movable upper sleeve 155 along its axis with respect to the fixed upper sleeve 154.

The auxiliary sliding means 159 are arranged above the body 61 of the handling device 60, so as to face the outer lateral surface of the tubular body 137 when it protrudes upwardly from the hollow cylinder 65.

Figure 4:
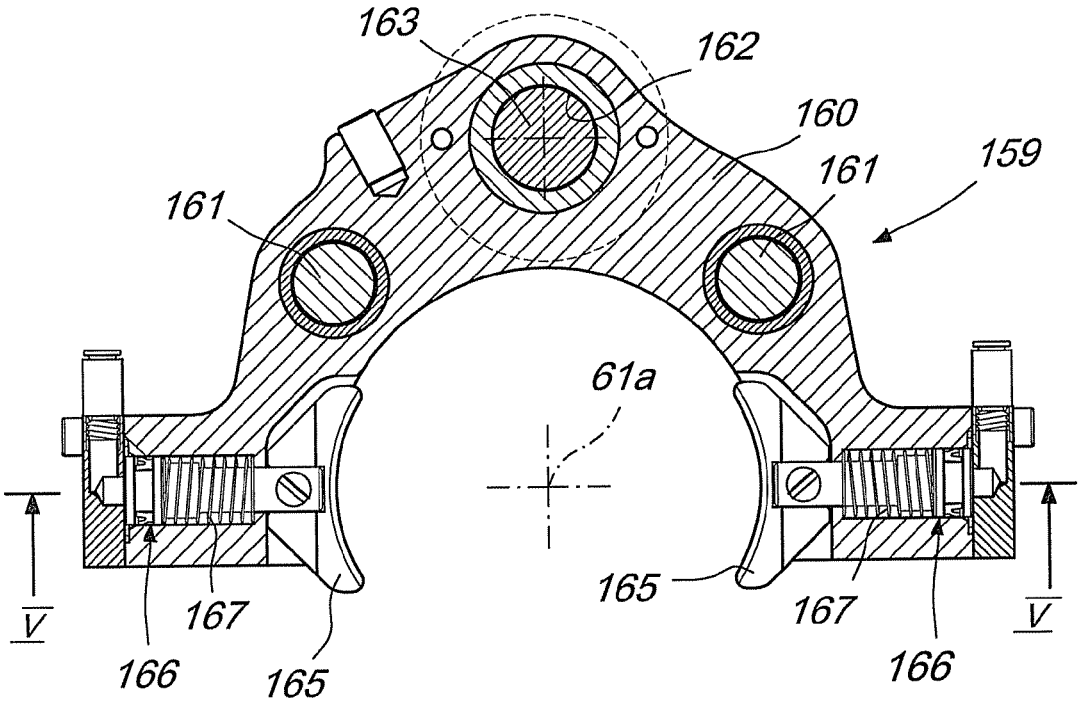
FIG. 4 is an enlarged-scale sectional view of FIG. 3, taken along the line IV-IV.
Figure 5:
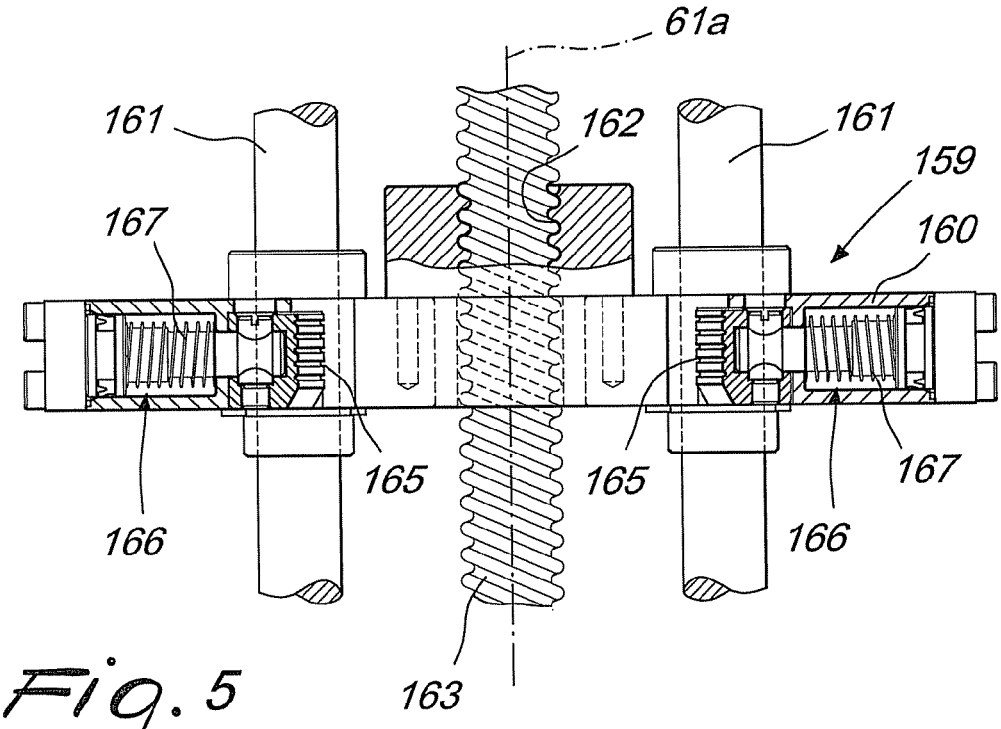
FIG. 5 is a sectional view of FIG. 4, taken along the line V-V.

The auxiliary sliding means 159, illustrated in particular in FIGS. 3, 4 and 5, comprise a slider 160, which is coupled slidingly to columns 161 which have a vertical axis and are fixed to the upper supporting structure 153. A lead screw 162 is defined in the slider 160 and a threaded shaft 163 mates with it and is supported, so that it can rotate about its own vertically oriented axis, by the upper supporting structure 153. The threaded shaft 163 is connected to the output shaft of an electric motor 164, which is mounted on the upper supporting structure 153. In practice, the actuation of the electric motor 164 causes the upwardly or downwardly sliding of the slider 160 along the columns 161, i.e., parallel to the axis 61*a*.

The slider 160 supports, in two regions that are diametrically opposite to each other with respect to the axis 61*a*, two pressers 165 which face each other and can move toward each other by way of the action of corresponding fluid-actuated cylinders 166, which are mounted on the slider 160, in contrast with the action of springs 167 or with mutual spacing by way of the action of the springs 167 so as to engage and disengage with respect to the outer lateral surface of the tubular body 137 or with the article 101 everted onto the outer lateral surface of the tubular body 137. The mutually facing faces of the pressers 165 are shaped like a portion of a cylindrical surface so as to mate with the outer lateral surface of the tubular body 137. Optionally, these faces of the pressers 165 can be knurled or toothed in order to increase their adhesion to the article 101.

It should be noted that both the lower end of the lower guiding cylinder 136 and the fixed upper sleeve 154 can be connected on command to pneumatic suction means of a known type, which are not shown for the sake of simplicity, in order to produce downwardly or upwardly suction through the tubular body 137.

The second axial pusher means 81 comprise an annular actuation body 82, which is fitted coaxially around the hollow cylinder 65 and is jointly connected thereto in rotation about the axis 61*a* with respect to the supporting structure 66. The annular actuation body 82 is connected to the hollow cylinder 65 by means of vertical guiding rods 83, shown in FIGS. 8 to 13 and 19, around which springs 84 are arranged which contrast the lowering of the annular body 82 with respect to the hollow cylinder 65.

The piston of at least one fluid-actuated cylinder 85 acts on command on the annular actuation body 82, and such cylinder is mounted on the supporting structure 66 and oriented so that its axis is vertical. The actuation of the fluid-actuated cylinder 85 causes the descent of the annular actuation body 82 with respect to the hollow cylinder 65 in contrast with the action of the springs 84, which act as return springs. A bearing 86 is interposed between the annular actuation body 82 and the piston of the fluid-actuated cylinder 85 and avoids friction between these two components during the rotation of the hollow cylinder 65 about its own axis, which coincides with the axis 61*a*.

Inside the cylindrical surface along which the spikes 62 are arranged when the half-rings 63*a* and 63*b* are coplanar, in the body 61 of the handling device 60 there is an annular seat 87, which is delimited radially outwardly indeed by the spikes 62.

An annular contact body 88 is accommodated in this annular seat 87; such body, too, is provided in two halves, like the half-rings 63*a* and 63*b*. Each of the two halves of the annular contact body 88 can move parallel to the axis 61*a* with respect to the spikes 62 by way of the action of the annular actuation body 82, which, when it is pushed downwardly by the fluid-actuated cylinder 85, acts on the annular contact body 88, by means of rods or struts 89, which are shown only in FIGS. 14 to 18, causing its downward motion. The rise of the annular contact body 88 when the action of the fluid-actuated cylinder 85 ceases can be achieved by means of return springs. It should be noted that the rods 89 that act on the half of the annular contact body 88 that is arranged in the half-ring 63*a* that is fixed to the hollow cylinder 65 can be fixed to this half of the annular contact body 88, while the struts 89 that act on the other half of the annular contact body 88 that is arranged in the half-ring 63*b* that can be turned over are conveniently provided in two separate parts indeed to allow the overturning of the half-ring 63*b* about the diametrical axis 64 with respect to the half-ring 63*a*. In FIGS. 14, 14*a*, 16 and 18, the annular actuation body 82, the hollow cylinder 65 and the annular contact body 88 have been shown in cross-section along planes that are different from the sectional planes used in FIGS. 8 to 13 and 19 to show the second axial pusher means 81.

In the preferred case in which the turner 130 is installed, as shown, at the sewing or looping station 102, in such sewing or looping station 102 there is a looping or sewing head 170, which is described briefly hereinafter only for the sake of completeness in description.

The sewing or looping head 170 is provided, in a per se known manner, with sewing elements, which are constituted by a needle 171 and a crochet or by a needle 171 and a yarn loading tube or by two needles 171 and 172 as shown, so as to form a sewing or looping chain stitch 173. The sewing or looping head 170 is further provided, proximate to the sewing elements, with a bearing 174 which has a horizontal axis and is designed to support the half-ring 63*b* when it is turned over below the half-ring 63*a* and while it is rotated about the axis 61*a*, together with the hollow cylinder 65, by way of the actuation of the electric motor 69.

The sewing or looping head 170 is provided with an electric motor 175 for the actuation of the sewing elements, and the actuation of such electric motor 175 is synchronized with the actuation of the electric motor 69, so that in each instance the needle 171 of the sewing or looping head 170 engages a spike 62 of the half-ring 63*b* that carries a pair of loops of knitting of the article 101, joining them.

The sewing or looping head 170 is provided with a cutter, of a type that is known and not shown for the sake of simplicity, for cutting the sewing or looping chain stitch 173 at the end of the sewing or looping operation.

Conveniently, the sewing or looping head 170 is mounted on a slider 176, which is jointly connected to guiding shafts 177, which are oriented so that their axes are horizontal and are supported, so that they can slide along their own axes, by the supporting structure 66. A linear actuator acts on the slider 176 and is of a known type which is not shown for the sake of simplicity, such as for example a fluid-actuated cylinder or an electric motor connected to the slider 176 by means of a screw-and-nut connection, which causes the translational motion on command of the slider 176 and therefore of the sewing or looping head 170 toward the axis 61*a*, so as to move the sewing or looping head 170 into a position that is adapted to interact with the spikes 62 of the half-ring 63*b* or away from the axis 61*a* so that it does not hinder the positioning of the pick-up body 11 in the sewing or looping station 102 and the overturning of the half-ring 63*b* with respect to the half-ring 63*a* around the diametrical axis 64.

The turner 130 can be completed by other sensors, which are not described in detail for the sake of simplicity, to control the movement of the several movable elements that compose the turner 130. The several sensors, as well as the several actuators needed to actuate the movable elements of the turner 130, are functionally connected to a control and actuation element of the programmable electronic type, which supervises the operation of the turner 130. This control and actuation element can be constituted by a single control and actuation element that supervises both the operation of the turner 130 and the operation of the machine used to produce the articles 101 as a function of preset operating programs.

Operation of the turner according to the invention, in the preferred case in which it is used in a sewing or looping station to close an axial end of tubular knitted articles, is as follows.

In inactive conditions, the turner 130 is arranged so that the tubular body 137 is supported by the lower portion 131 and is completely lowered and its axis coincides with the axis 61*a*.

Figure 8:
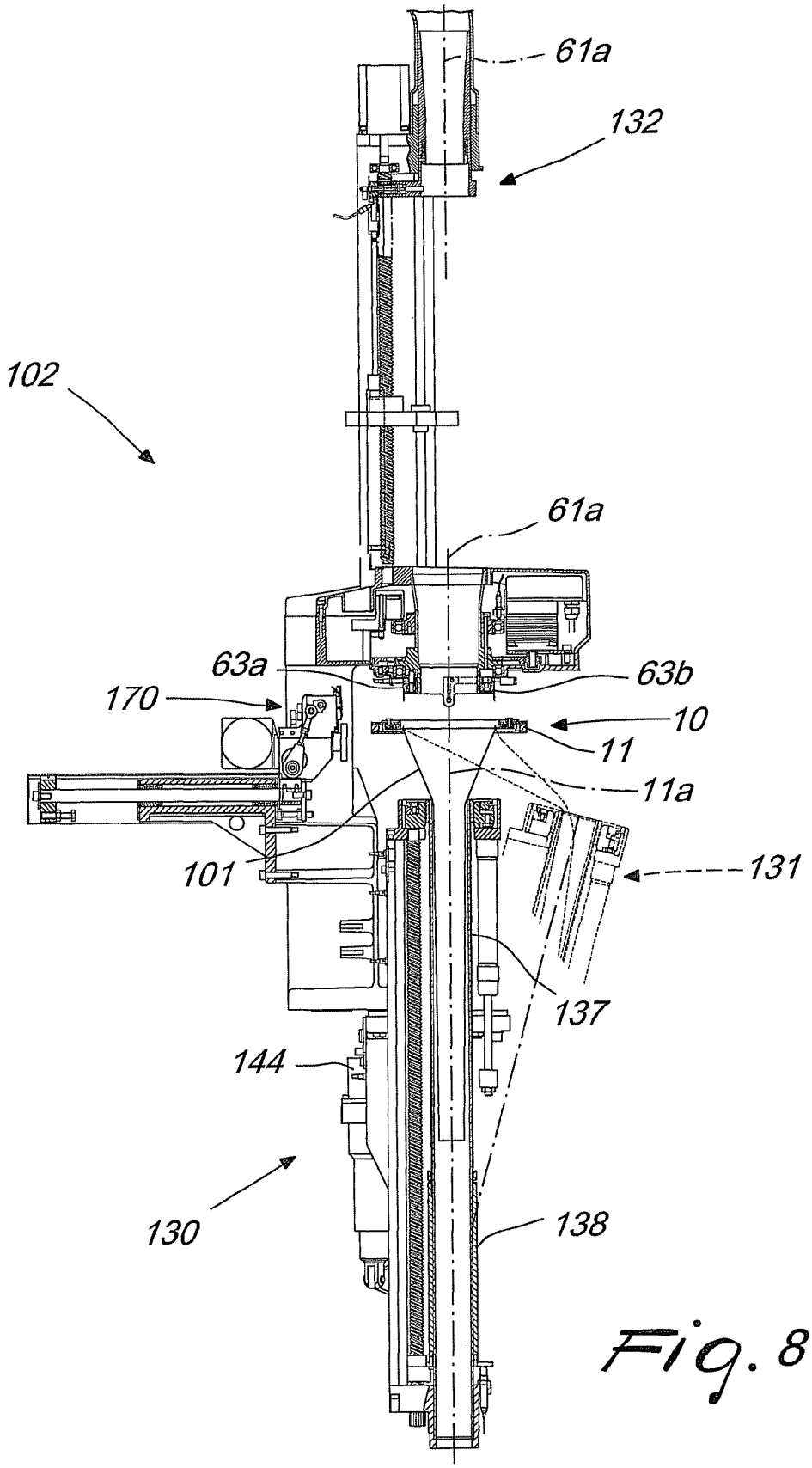
FIGS. 8 to 19 are schematic views of the operation of the turner according to the invention, more particularly.
Figure 8A:
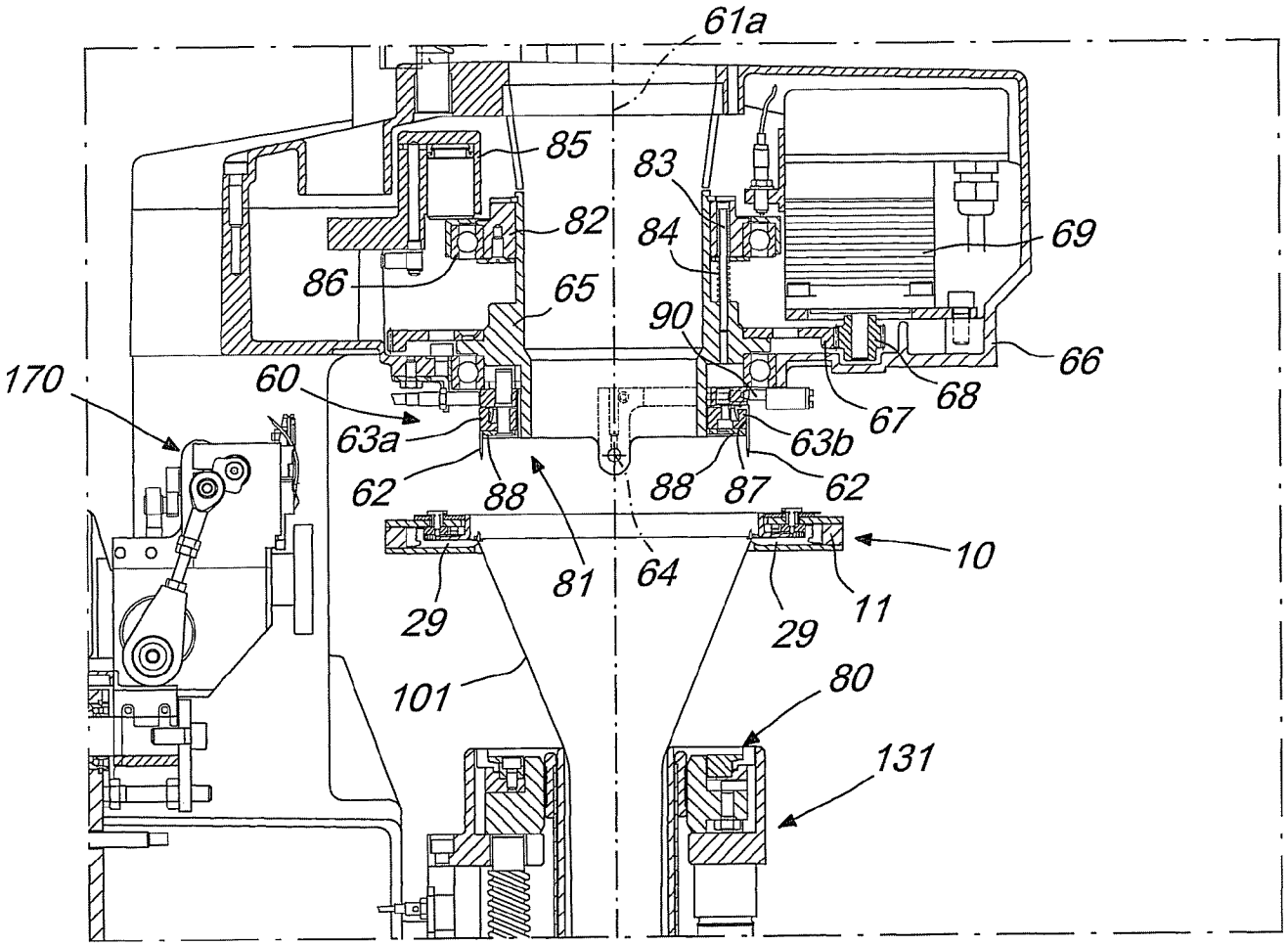
FIG. 8*a* is an enlarged-scale view of a detail of FIG. 8.

Once the article 101 to be turned has been picked up from the machine used to produce it, if a pick-up device 10 is used which is designed to release the article 101 to the handling device 60 that will support it during turning, the pick-up body 11, which retains the loops of knitting of the last formed row of knitting of the article 101 on its pick-up members 29, is positioned so that its axis 11*a* lies at the axis 61*a*, below the body 61 of the handling device 60 (FIGS. 8, 8*a*).

During the transfer of the article 101 from the machine used to produce it to the sewing or looping station 102, particularly in the case of articles 101 of considerable length, the lower portion 131 can be inclined with respect to the axis 61*a*, as shown in FIG. 2 and as shown in broken lines in FIG. 8, so as to come closer, with the upper axial end of the tubular body 137, the interior of which is connected to suction means, to the machine used to produce the article 101. This approach facilitates the suction, inside the tubular body 137, through its upper axial end, of the article 101, which hangs with its upper end from the pick-up members 29 of the pick-up device 10. Subsequently, the lower portion 131 is returned so that the axis of the tubular body 137 is located at the axis 61*a*.

Figure 9:
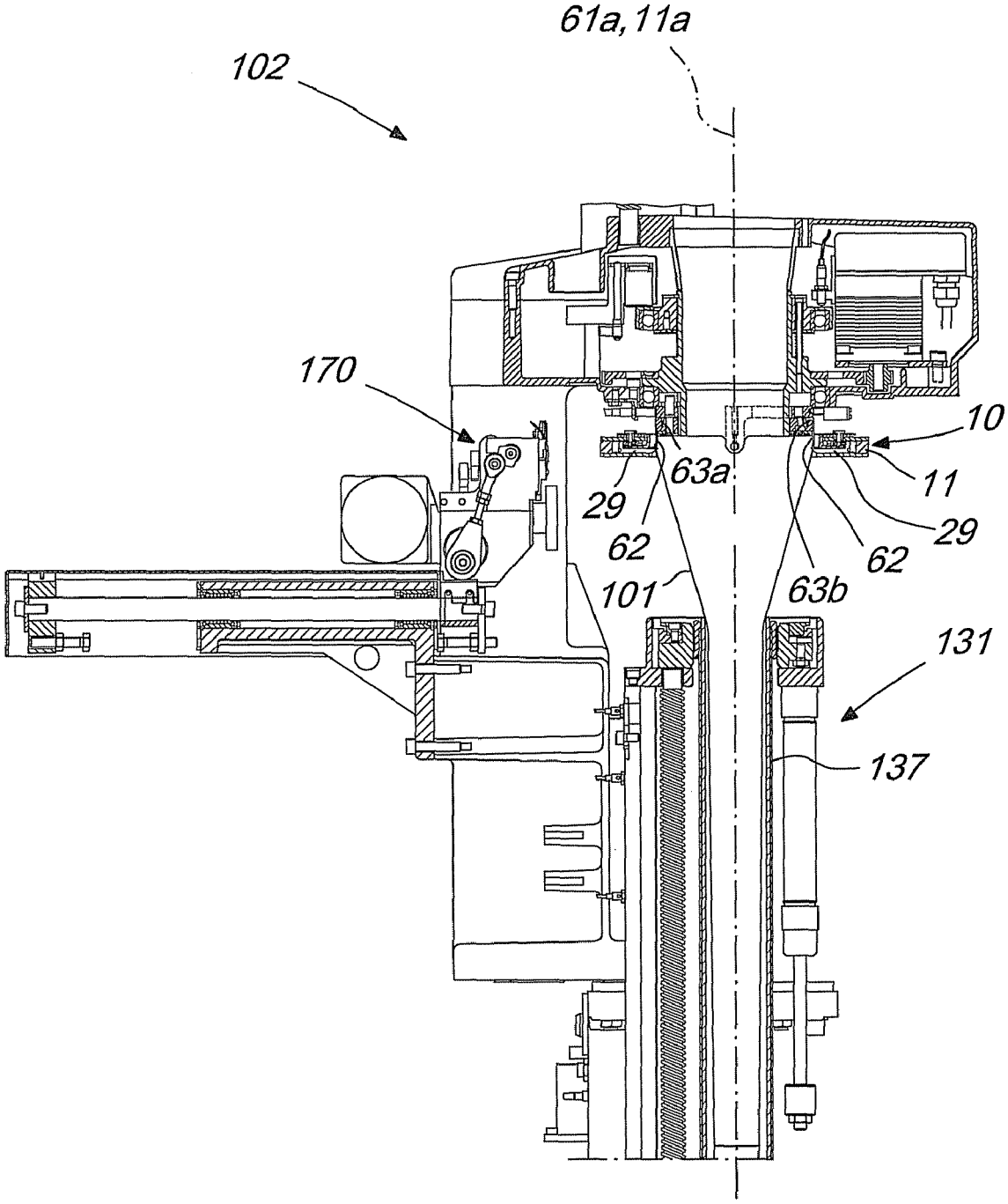
Figure 9A:
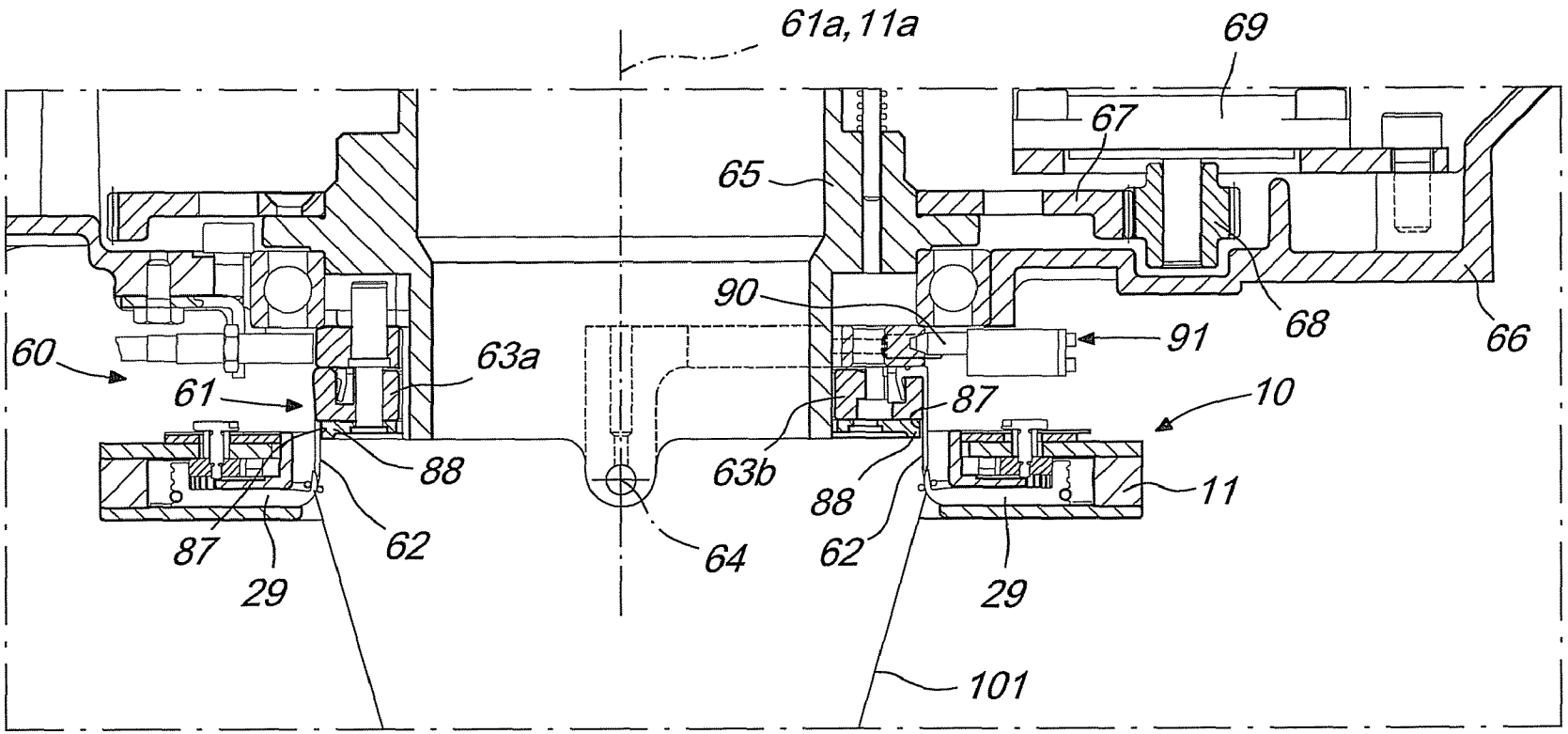
FIGS. 9*a* and 10*a* are enlarged-scale detail views, respectively of FIG. 9 and FIG. 10.

The pick-up body 11, which lies between the upper axial end of the tubular body 137 supported by the lower sleeve 138 and the two half-rings 63*a*, 63*b* in a coplanar position, is then raised so that each one of the pick-up members 29 mates with a spike 62 (FIGS. 9 and 9*a*).

Figure 10:
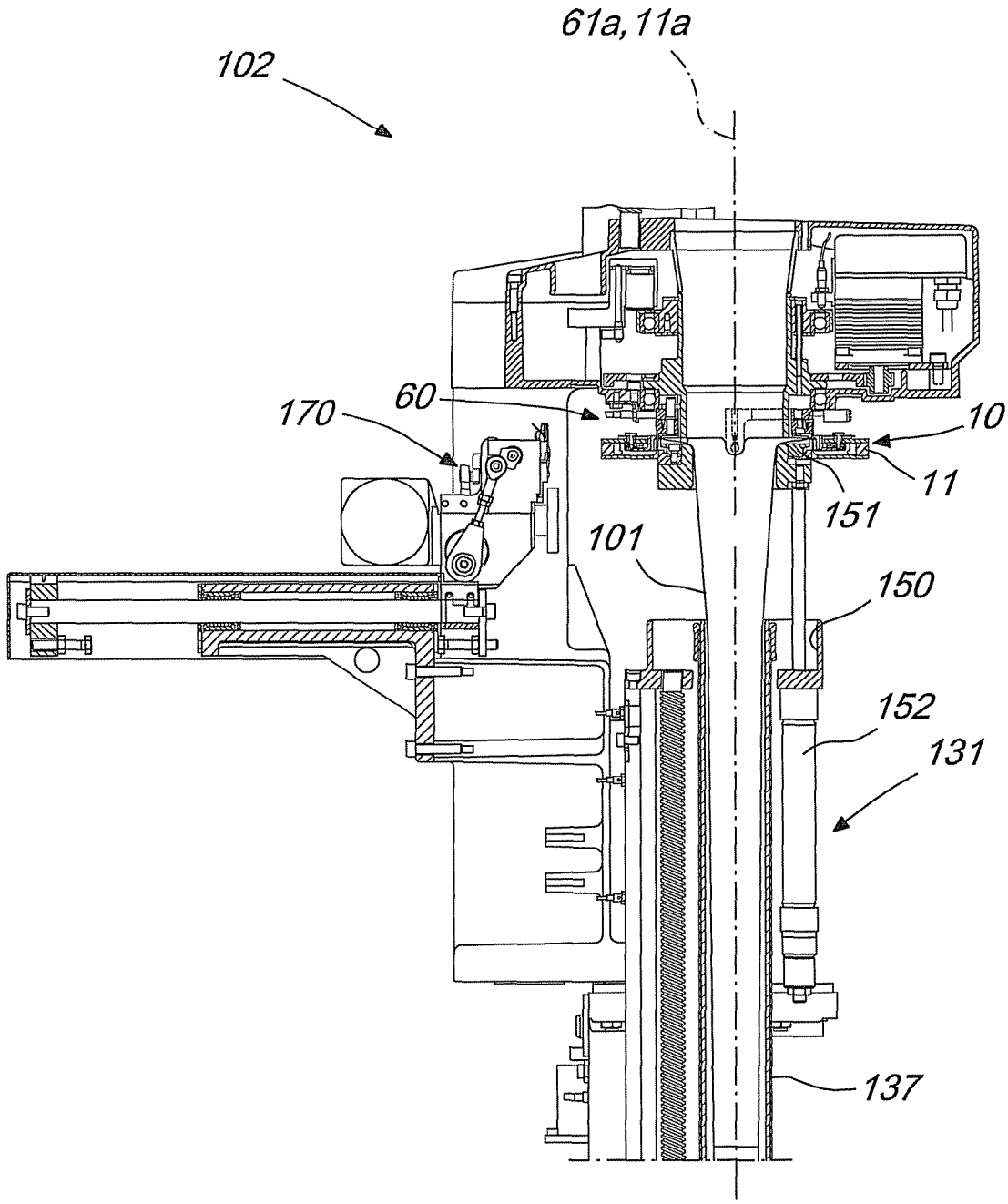
Figure 10A:
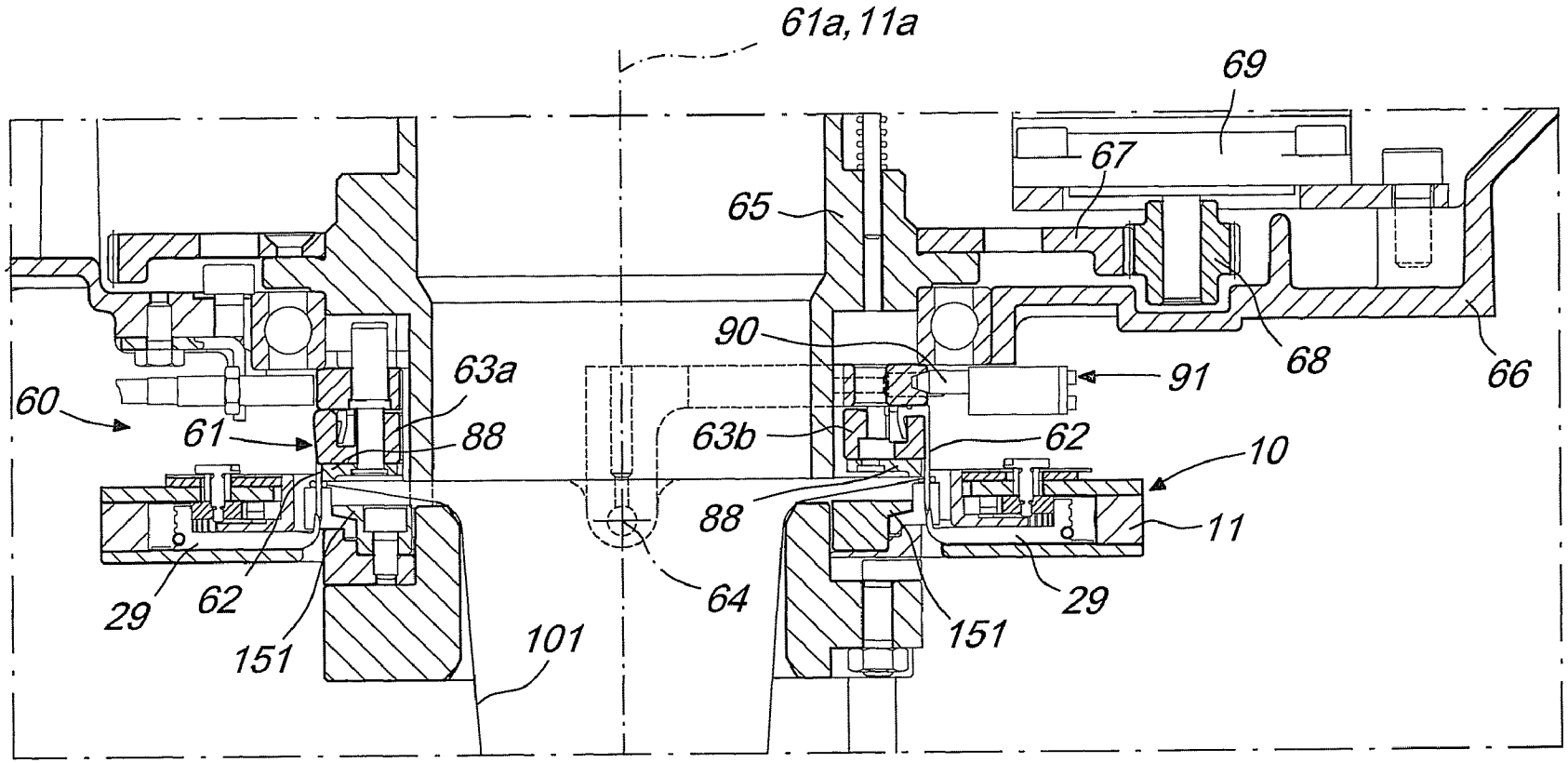

The fluid-operated cylinder 152 is then actuated and lifts the annular body 151 along the axis 61*a*. The annular body 151 penetrates with the teeth of its peripheral profile between the pick-up members 29, causing the individual passage of the loops of knitting from the pick-up members 29 to the spikes 62. In this manner, each spike 62 carries a loop of knitting of the last row of knitting formed by the needles of the machine used to produce the article (FIGS. 10 and 10*a*).

Figure 11:
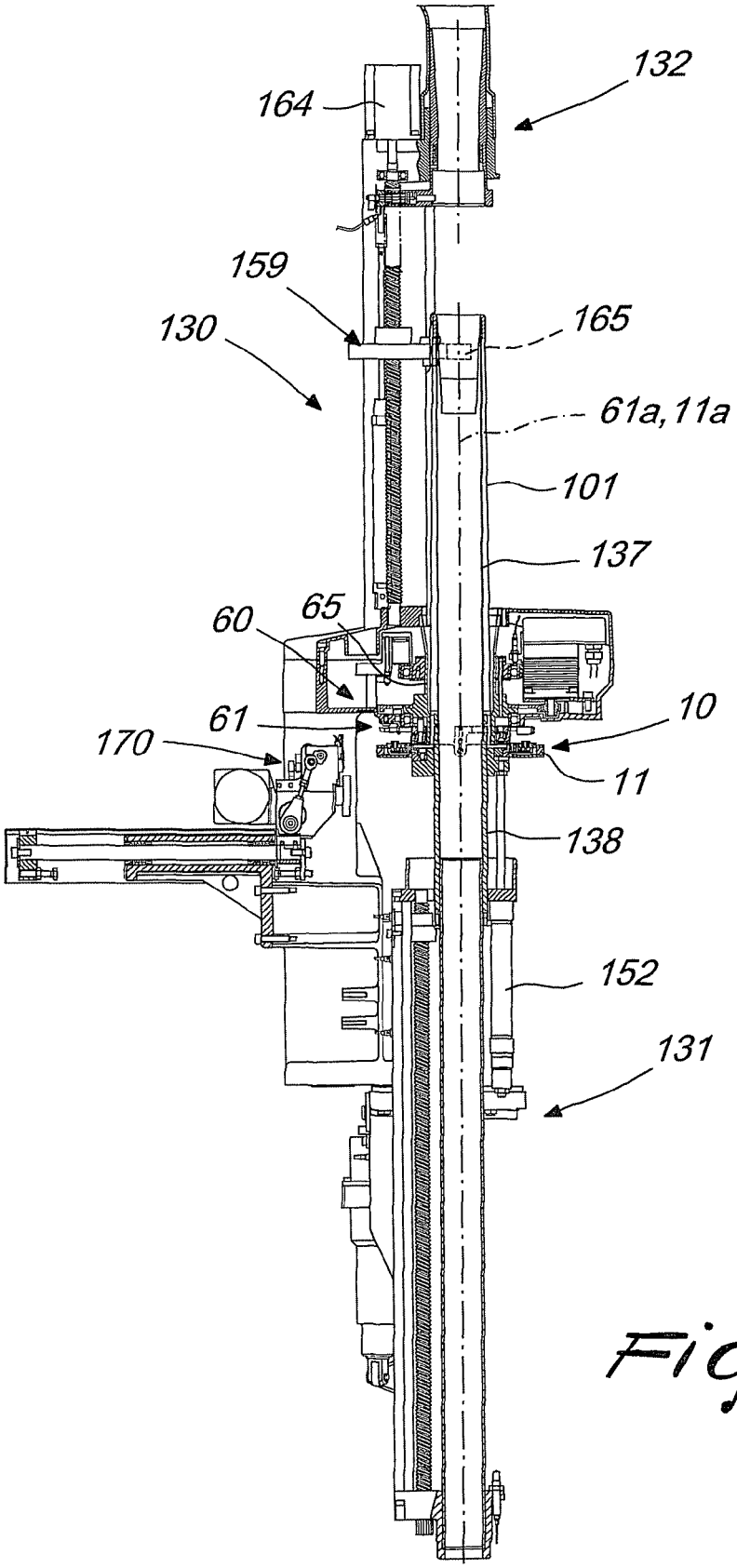

While the annular body 151 is kept in the raised position, the actuation of the electric motor 142 actuates the lifting, along the axis 61*a*, of the lower sleeve 138 and therefore of the tubular body 137 that passes, with its upper axial end, through the pick-up body 11 and the body 61 of the handling device 60 passing in the hollow cylinder 65 and reaching the raised position (FIG. 11). This upward translational motion of the tubular body 137 causes the turning of the article 101, which hangs with its last formed row of knitting from the spikes 62, above the spikes 62. The lifting of the tubular body 137 is stopped when its lower axial end lies directly above the body 61, constituted by the two half-rings 63*a*, 63*b*, which are still in a coplanar position. If the article 101 is shorter than the axial space occupation of the tubular body 137, the upward translational motion of the tubular body 137 is sufficient on its own to complete the turning of the article 101.

If the article 101 is instead longer, its turning onto the outer lateral surface of the tubular body 137 is completed by the auxiliary sliding means 159.

More particularly, with the tubular body 137 in the raised position, the pressers 165, by way of the combined actuation of the fluid-actuated cylinders 166 and of the electric motor 164, are engaged cyclically with the portion of the article 101 that is already everted onto the outer lateral surface of the tubular body 137 and are simultaneously lowered and thus disengaged from the article 101 and simultaneously raised so as to push the article 101 toward the lower axial end of the tubular body 137, until its extraction from the upper axial end of the tubular body 137 is completed.

Figure 12:
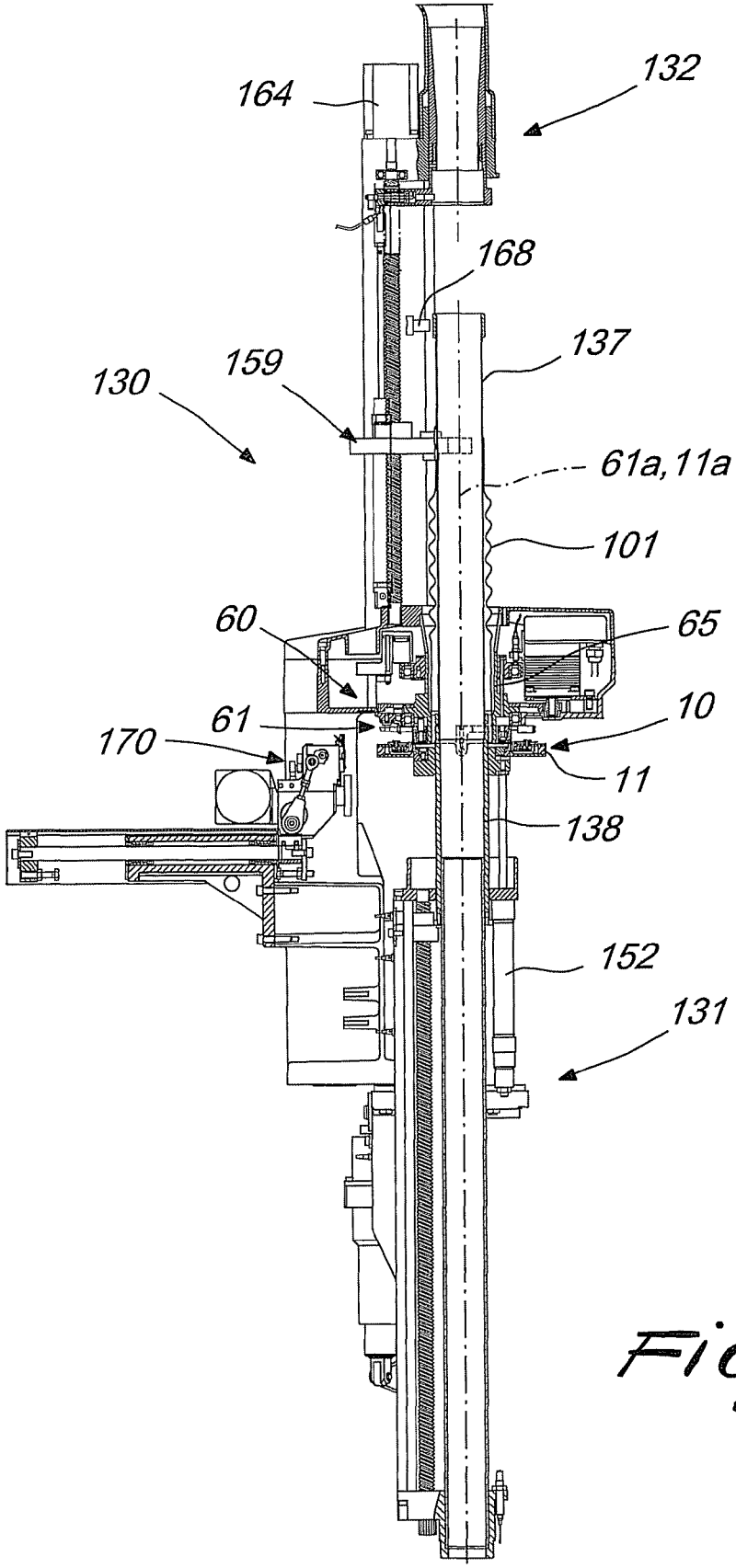

Completion of the eversion of the article 101 onto the outer lateral surface of the tubular body 137 can be detected by means of an optical detector, constituted for example by a photocell 168 that faces the upper edge of the tubular body 137 and inhibits the actuation of the auxiliary sliding means 159 if their intervention is not needed or ceases their actuation when they have completed the eversion of the article 101 (FIG. 12).

Figure 13:
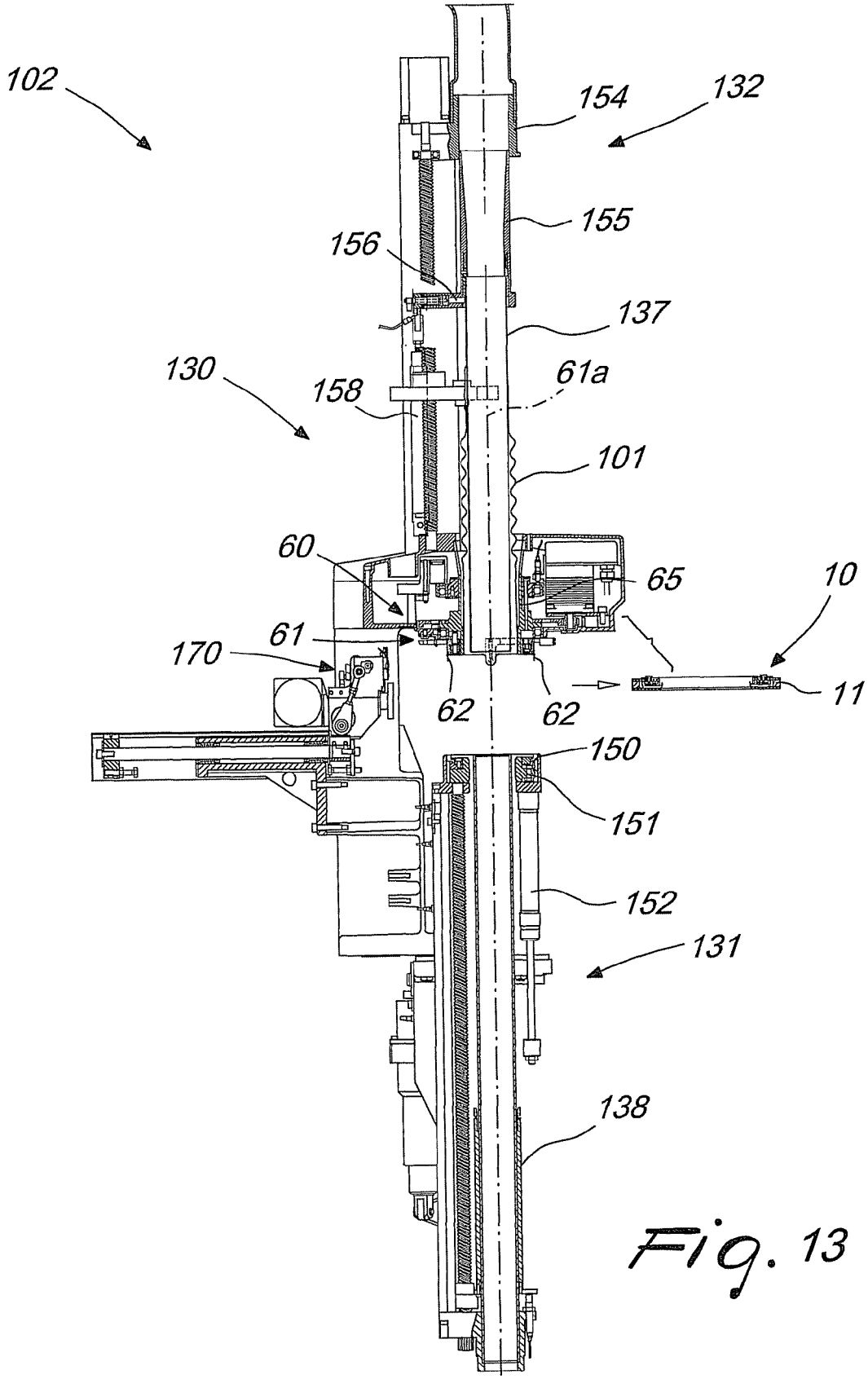

After completion of the turning of the article 101, which is thus in the inside-out configuration, by means of the fluid-actuated cylinder 158 the movable upper sleeve 155 is lowered until its lower end fits around the protruding edge of the upper axial end of the tubular body 137. Subsequently, the fluid-actuated cylinder 157 is actuated and, by means of the movable pin 156, engages the tubular body 137 proximate to its upper axial end. Subsequently, the fluid-actuated cylinder 152 is actuated so as to return the annular body 151 into the annular seat 150 and the electric motor 142 is actuated so as to cause the complete lowering of the lower sleeve 138 along the lower guiding cylinder 136. At this point, the pick-up body 11 is moved away from the turner 130 (FIG. 13).

Figure 14:
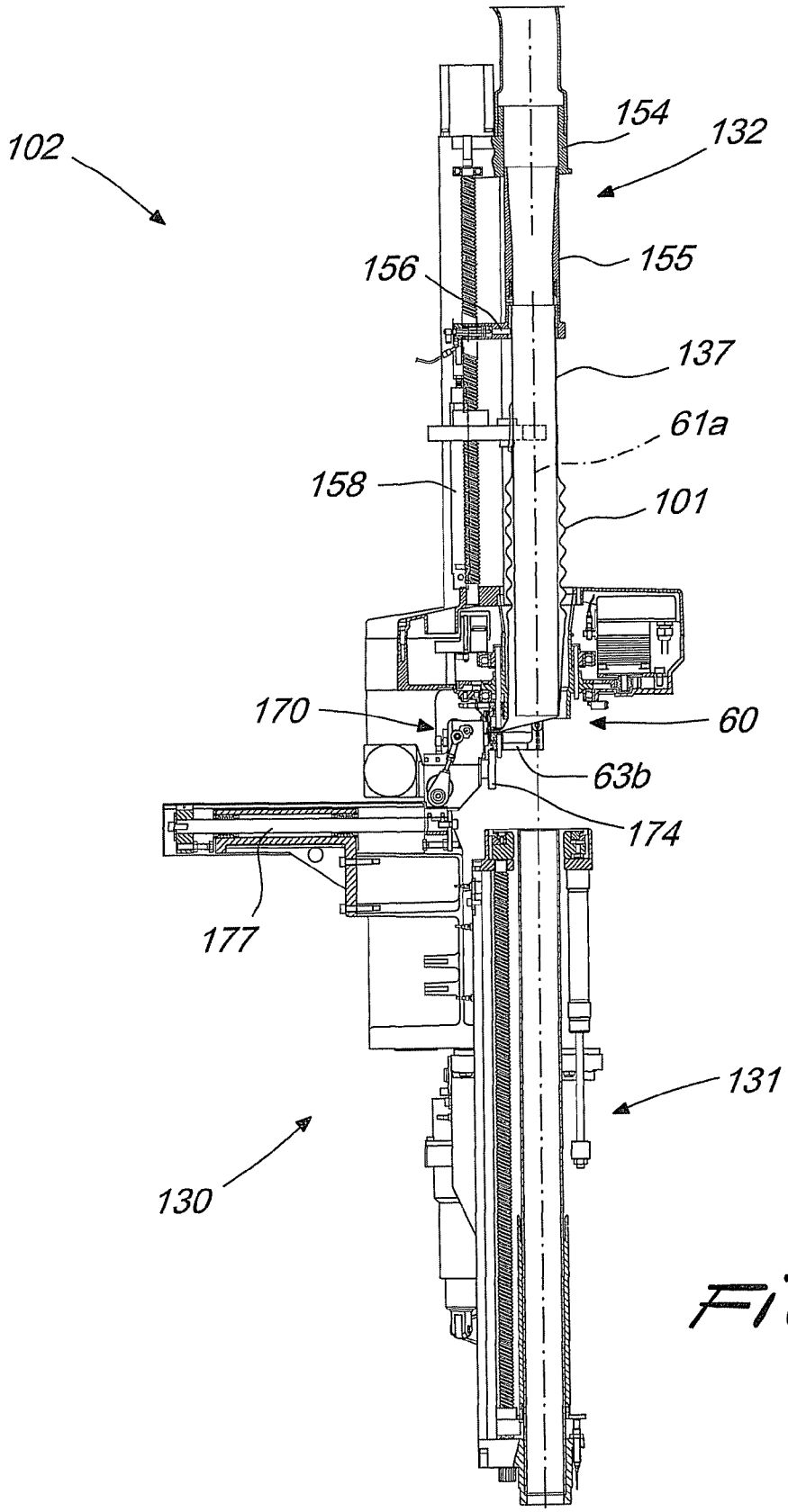
Figure 14A:
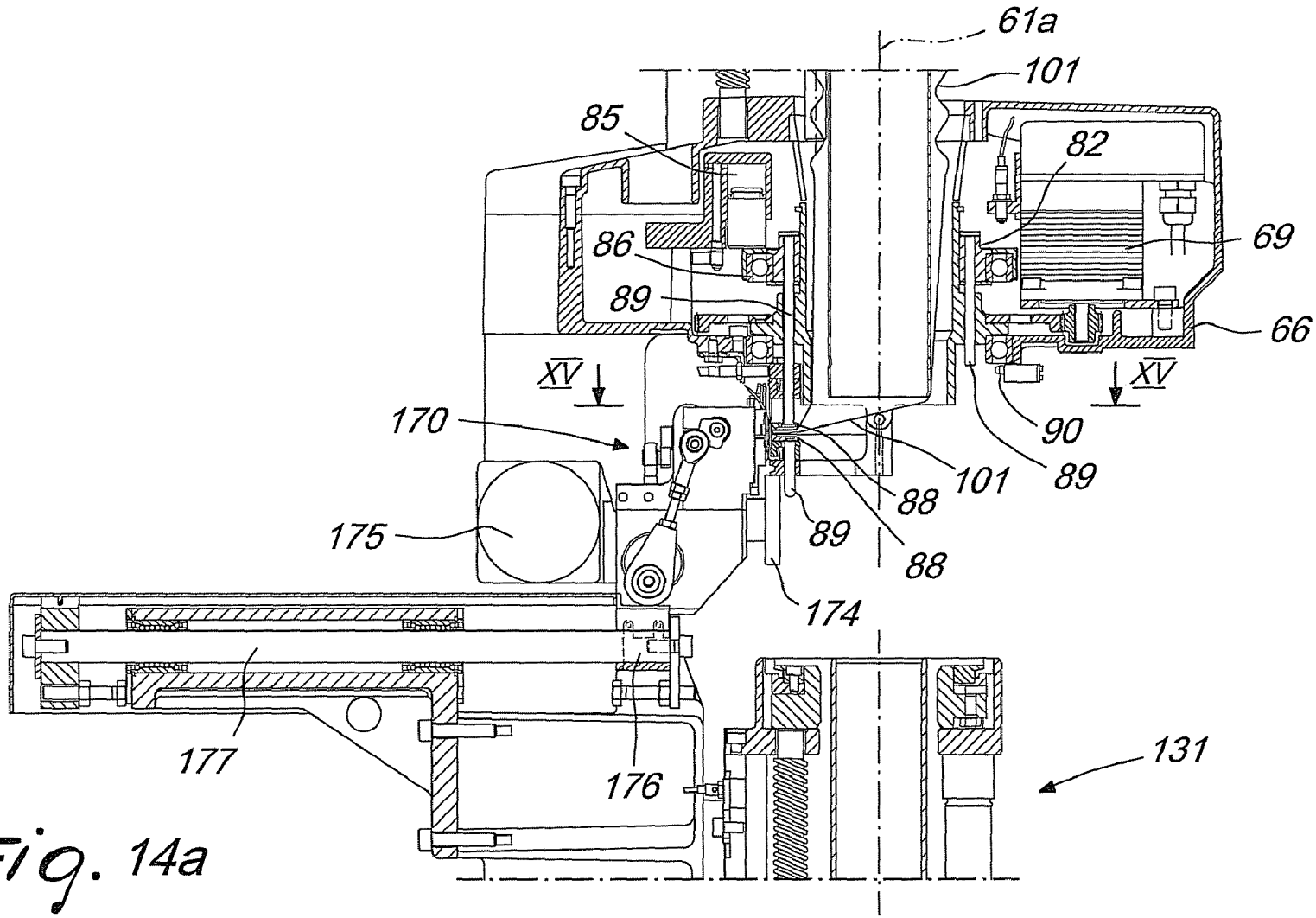
FIG. 14*a* is an enlarged-scale view of a detail of FIG. 14.

The half-ring 63*b* is then turned over, by way of the actuation of the fluid-actuated cylinder 70, about the diametrical axis 64 below the half-ring 63*a* so that each one of the spikes 62 of the half-ring 63*b* faces and is aligned below a spike 62 of the half-ring 63*a*, as shown in FIG. 6. After the overturning of the half-ring 63*b*, the sewing or looping head 170 is moved toward the half-ring 63*b* so as to support in a downward region, by means of the bearing 174, the half-ring 63*b*. By way of the actuation of the fluid-actuated cylinder 85, the annular actuation body 82 is lowered and causes the lowering of the half of the annular contact body 88 that is arranged in the half-ring 63*a*, which transfers the loops of knitting from the spikes 62 of the half-ring 63*a* to the spikes 62 of the half-ring 63*b*. In this manner, each spike 62 of the half-ring 63*b* supports a pair of loops of knitting (FIGS. 14 and 14*a*).

Figure 15:
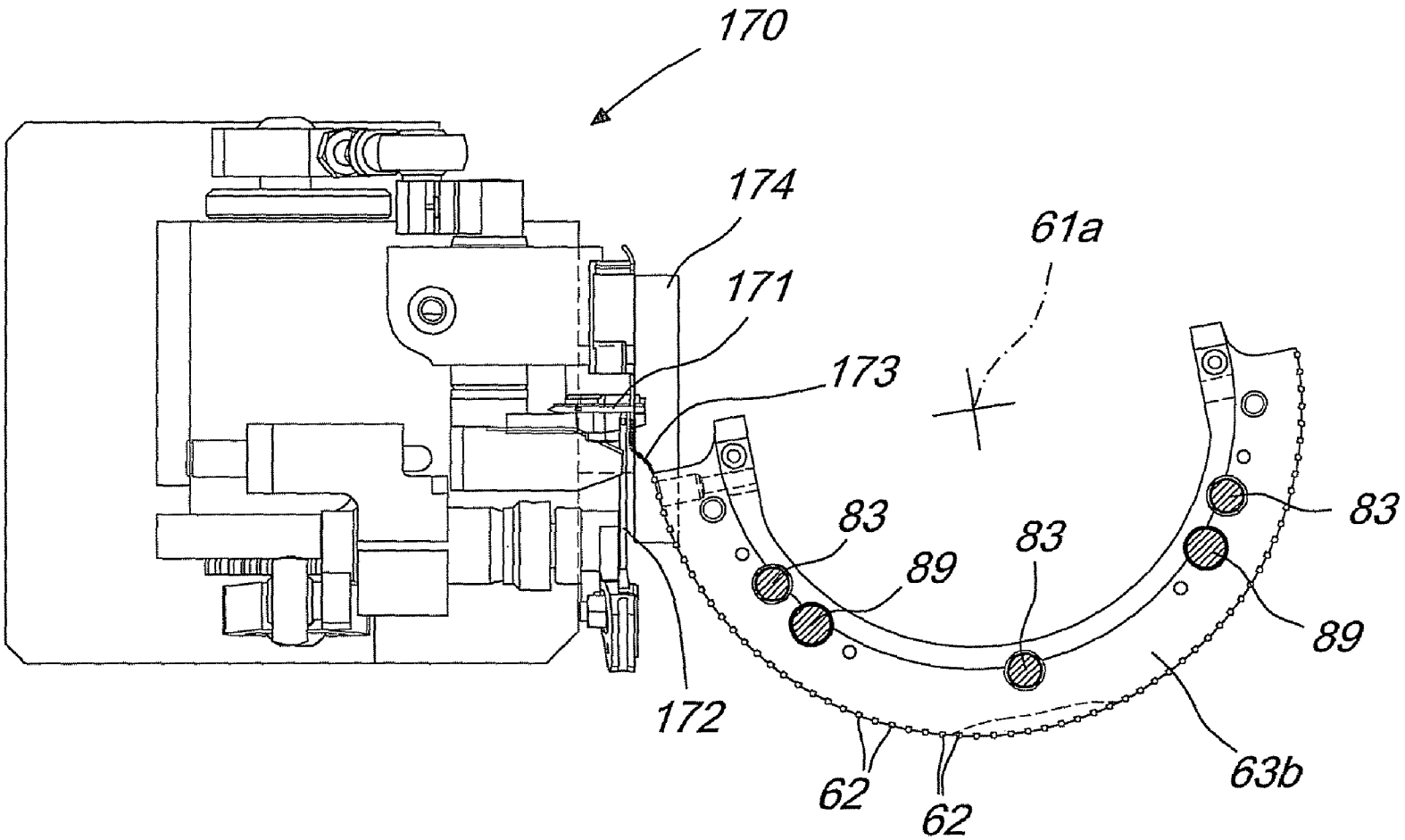

At this point, the motor 175 that actuates the sewing elements of the sewing or looping head 170 and the electric motor 69 are actuated synchronously with each other so that the half-ring 63*b* is rotated about the axis 61*a* and so that during this rotation the needle 171 of the sewing head 170 interacts in each instance with a spike 62 of the half-ring 63*b*, joining the pairs of loops of knitting that are arranged on a same spike 62. In this manner, the axial end of the tubular article 101 is closed in the inside-out configuration (FIG. 15).

Figure 16:
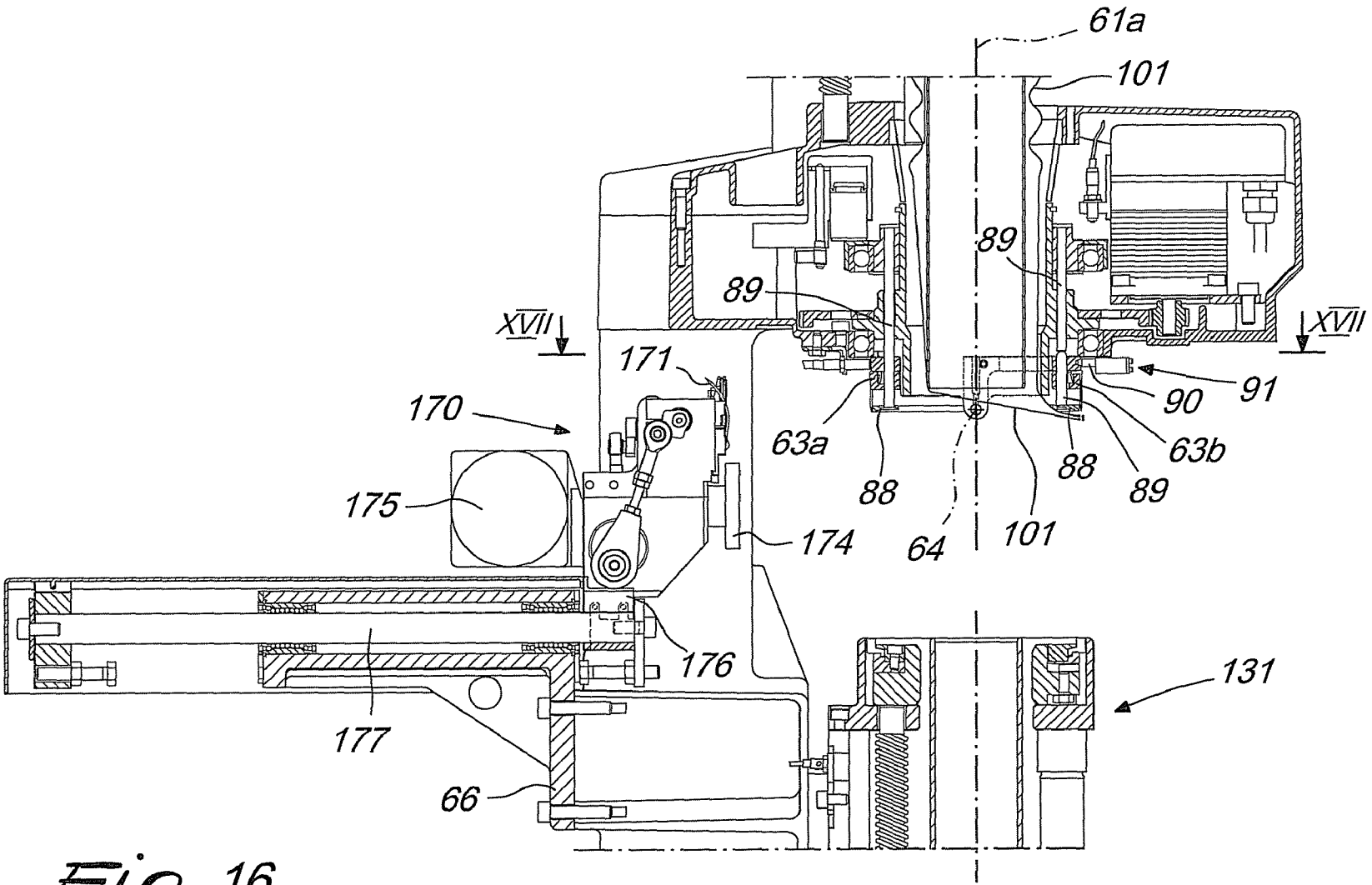
Figure 17:
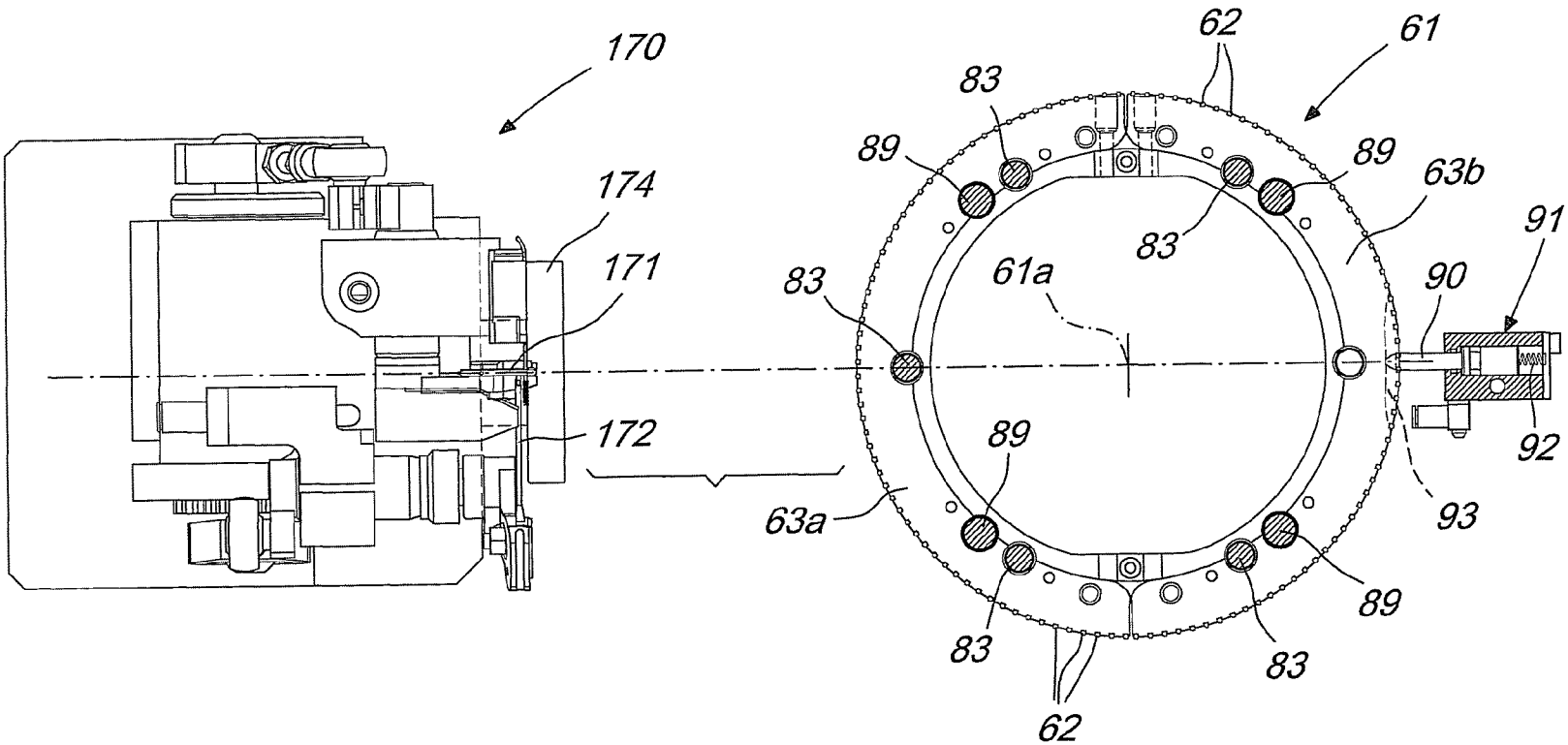

At the end of the sewing or looping, the sewing or looping chain stitch 173 is cut and the sewing or looping head 170 is moved away from the half-ring 63*b*. Such half-ring, after being returned to the rotational position about the axis 61*a* that it occupied before the sewing or looping operation began, and after lifting the annular contact body 88, is turned over about the diametrical axis 64 by means of a new intervention of the fluid-actuated cylinder 70 in the opposite direction with respect to the preceding one, and returned to a position that is coplanar to the half-ring 63*a* in which it is locked by the pin 90. At this point, the annular contact body 88 is lowered again and causes the disengagement of the article 101 from the spikes 62 of the half-ring 63*b*(FIGS. 16 and 17).

The article 101, by way of the suction generated in the meantime by the connection of the fixed upper sleeve 154 to suction means, is aspirated, starting from its end that has just been closed inside the tubular body 137 through the lower axial end of the tubular body 137.

The suction of the article 101, starting from its end that has just been closed, through the lower axial end of the tubular body 137, achieves the turning of the article 101, which is thus returned to the right-way-out configuration.

Figure 18:
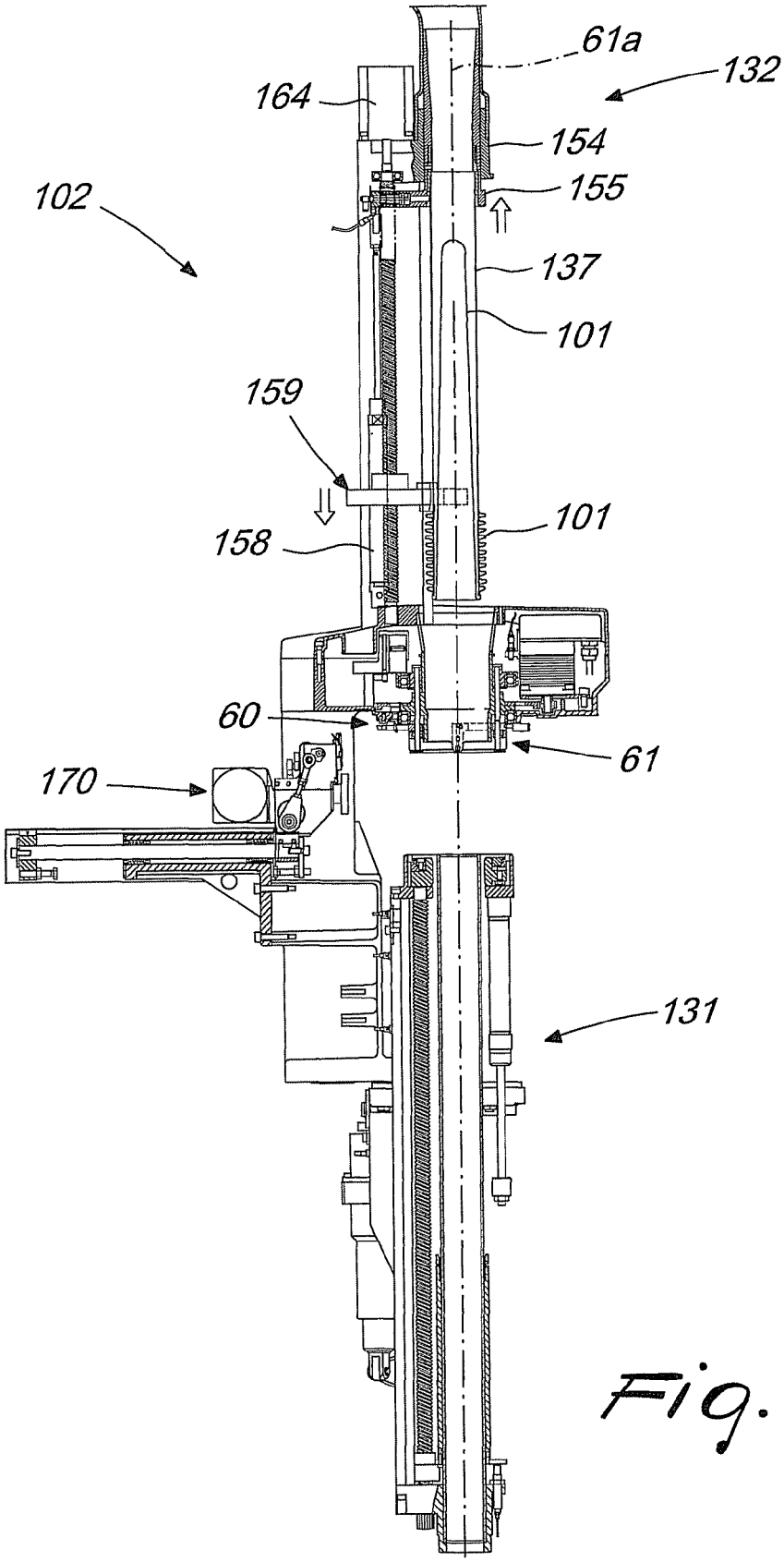

The suction of the article 101 into the tubular body 137 through its lower axial end can be conveniently assisted by the actuation of the auxiliary sliding means 159, which pushes the article 101 toward the lower axial end of the tubular body 137, which again to facilitate this suction of the article 101 in the tubular body 137 can be raised further, by lifting the movable upper sleeve 155 actuated by the fluid-actuated cylinder 158, until its lower axial end is moved above the hollow cylinder 65 (FIG. 18).

It should be noted that if it is required that the article 101, after being turned to bring it to the inside-out configuration, must not be turned again to be brought to the right-way-out configuration, it is possible to actuate the suction of the article 101 through the lower axial end of the tubular body 137, starting from the open axial end of the article 101, i.e., from its upper axial end. This can be achieved by pushing the article 101 below the lower axial end of the tubular body 137, by way of the auxiliary sliding means 159, while the tubular body 137 is moved, by lifting the movable upper sleeve 155, to the further raised position, shown in FIG. 18, before connecting the interior of the tubular body 137 to the suction means.

Figure 19:
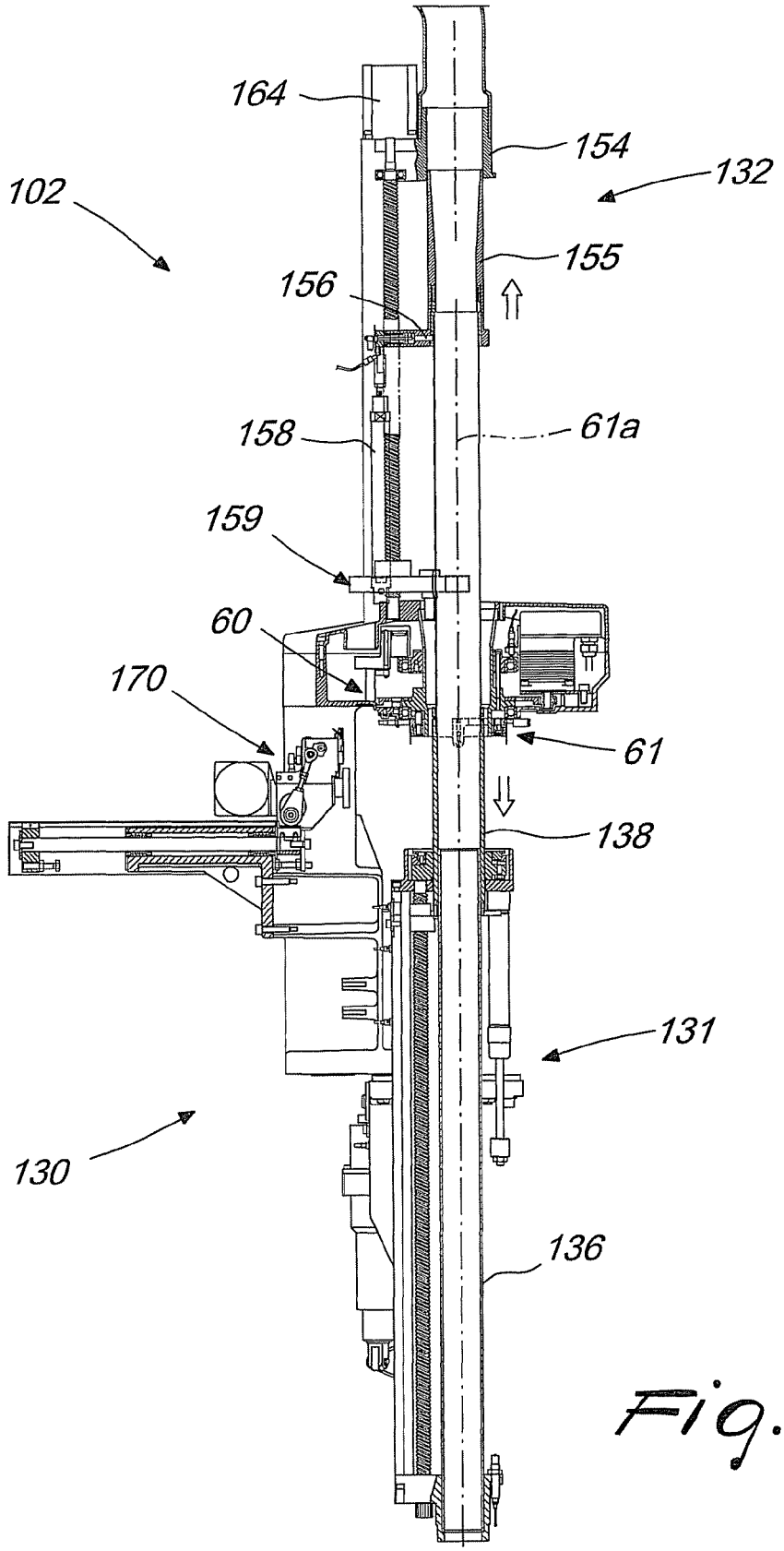

After the article 101 has been moved away from the turner 130, the movable upper sleeve 155 is lowered and the lower sleeve 138 is raised, so that the lower axial end of the tubular body 137 enters the lower sleeve 138 (FIG. 19). The movable pin 156 is then disengaged from the protruding edge of the upper axial end of the tubular body 137, which by way of the lowering of the lower sleeve 138 is returned to the lowered position around the lower guiding cylinder 136. The movable upper sleeve 155 is raised so as to return the turner 130 to the condition shown in FIG. 8, ready to receive a new article 101 to be closed at one of its axial ends.

Of course, the turner according to the invention, though being conceived to be used preferably in sewing or looping stations in which the automated closure of tubular knitted articles at one of their axial ends is performed, can also be used to merely turn tubular articles. In this case, the operation of the device is similar to what has been described, with the difference that the steps for preparing the article 101 for sewing or looping are absent and the article 101, once brought to the inside-out configuration, is not turned again to be brought back to the right-way-out configuration.

In practice it has been found that the turner according to the invention fully achieves the intended aim, since although it can have a reduced vertical space occupation it is capable of correctly turning articles of considerable lengths. Moreover, the turner according to the invention can correctly turn particularly glossy or delicate articles, avoiding the danger of damage or breakage thereof.

The turner thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2008A000399 from which this application claims priority are incorporated herein by reference.

The invention claimed is:

1. A turning device for tubular knitted articles, comprising a lower portion and an upper portion, which are arranged respectively below and above an intermediate region at which means for supporting the tubular article to be turned can be positioned, the tubular article to be turned hangs at one of the axial ends of said supporting means and is arranged substantially vertically, and a tubular body, which can be inserted from the bottom upwardly, with the upper axial end of said tubular body, through said axial end of the article that hangs from said supporting means after aspirating the article through said upper axial end of the tubular body, for the eversion of the article, retained by said supporting means, onto the outer lateral surface of said tubular body with progressive extraction of the article from said upper axial end of the tubular body, further comprising auxiliary sliding means, which can move on command with respect to said tubular body, parallel to the axis of said tubular body, and can engage and disengage cyclically the article everted onto the outer lateral surface of said tubular body in order to produce the sliding of the article toward the lower axial end of said tubular body, wherein said lower portion can be inclined on command with respect to said vertical main axis with said tubular body supported by said lower portion and in said lowered position.

2. The device according to claim 1, wherein said means for supporting the article to be turned comprise a handling device provided with an annular body, which is arranged so that its axis lies at a vertical main axis and supports a plurality of spikes, which are arranged along an imaginary cylindrical surface whose axis coincides with the axis of said body of the handling device and are adapted to support the article to be turned, which hangs at an axial end thereof, said tubular body being arrangeable so that its axis lies at said vertical main axis and being movable on command along said vertical main axis.

3. The device according to claim 2, wherein said tubular body can be supported by way of said lower portion or by way of said upper portion, the interior of said tubular body being connectable to pneumatic suction means, said tubular body being movable on command at least from a lowered position, in which it faces with its upper axial end, in a downward region, said body of the handling device, to a raised position, in which it is arranged with its upper axial end above said body of the handling device and with its lower axial end proximate to said body of the handling device, in order to pass through said body of the handling device and evert the article at least partially, said article hanging from said handling device and being aspirated through the upper axial end of said tubular body, on the outer lateral surface of said tubular body, and vice versa.

4. The device according to claim 2, wherein said lower portion comprises lower means for supporting said tubular body with its axis arranged at said vertical main axis and lower means for the actuation of said tubular body along said vertical main axis in order to make said tubular body pass through said body of the handling device starting from said lowered position to said raised position and vice versa.

5. The device according to claim 4, wherein said upper portion comprises upper supporting means which can engage the upper axial end of said tubular body to lift it along said main vertical axis from said raised position to a further raised position, in which its lower axial end is spaced upwardly with respect to said body of the handling device, and vice versa.

6. The device according to claim 5, wherein said lower supporting means and said upper supporting means are adapted to connect the interior of said tubular body to said pneumatic suction means.

7. The device according to claim 2, wherein said body of the handling device is composed of two half-rings, one of said two half-rings being able to turn over with respect to the other half-ring about a diametrical axis in order to individually make its spikes face, and be aligned with, the spikes of the other half-ring of the body of the handling device.

8. The device according to claim 7, comprising first axial pusher means, which are adapted to interact with a pick-up device and with said spikes of the handling device in order to actuate the individual passage of the loops of knitting of one row of knitting of an article from said pick-up device to said spikes of the handling device.

9. The device according to claim 8, comprising second axial pusher means, which interact with the spikes of said handling device to actuate the passage of the loops of knitting from the spikes of a half-ring to the spikes that face them of the other half-ring that is turned or to disengage the loops of knitting from the spikes of said handling device.

10. The device according to claim 2, wherein said auxiliary sliding means comprise a slider that is coupled, so that it can slide along a direction that is parallel to said vertical main axis, to a supporting structure; said slider being movable on command parallel to said vertical main axis with respect to said supporting structure; and said slider supporting, in two mutually diametrically opposite regions with respect to said vertical main axis, two mutually facing pressers that can move on command toward or away from each other in order to engage or disengage the outer lateral surface of said tubular body in said raised position or in said further raised position.

11. The device according to claim 10, wherein the mutually facing faces of said pressers are shaped like a portion of a cylindrical surface in order to mate with the outer lateral surface of said tubular body.

12. The device according to claim 10, wherein the mutually facing faces of said two pressers are knurled or toothed in order to increase their adhesion to the article everted onto the outer lateral surface of said tubular body.

13. The device according to claim 1, comprising means for detecting the complete eversion of the article onto the outer lateral surface of said tubular body.

* * * * *